US007892051B2

(12) United States Patent
Nakajima

(10) Patent No.: US 7,892,051 B2
(45) Date of Patent: Feb. 22, 2011

(54) COMPRESSOR TERMINAL COVER

(75) Inventor: Hideyuki Nakajima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 35 days.

(21) Appl. No.: 12/094,118

(22) PCT Filed: Nov. 22, 2006

(86) PCT No.: PCT/JP2006/323332

§ 371 (c)(1),
(2), (4) Date: May 16, 2008

(87) PCT Pub. No.: WO2007/060995

PCT Pub. Date: May 31, 2007

(65) Prior Publication Data

US 2009/0233498 A1 Sep. 17, 2009

(30) Foreign Application Priority Data

Nov. 25, 2005 (JP) ..... 2005-340938

(51) Int. Cl.
*H01R 13/46* (2006.01)

(52) U.S. Cl. ..... 439/892; 439/521

(58) Field of Classification Search ..... 439/892, 439/893, 519, 521, 134, 135; 174/138 F
See application file for complete search history.

(56) References Cited

U.S. PATENT DOCUMENTS 5,578,794 A * 11/1996 Lamb et al. ..... 174/535
6,540,543 B1 * 4/2003 Watanabe ..... 439/354
2004/0179966 A1 * 9/2004 Kawashima et al. ..... 417/572

FOREIGN PATENT DOCUMENTS

| | | | |
|---|---|---|---|
| JP | 51-126408 | U | 10/1976 |
| JP | 54-7402 | U | 1/1979 |
| JP | 57-201231 | U | 12/1982 |
| JP | 62-174581 | A | 7/1987 |
| JP | 04-166684 | A | 6/1992 |
| JP | 05-089930 | U | 12/1993 |
| JP | 2002-373734 | A | 12/2002 |
| JP | 2003-328943 | A | 11/2003 |
| JP | 2004-293539 | A | 10/2004 |
| JP | 2005-146901 | A | 6/2005 |
| JP | 2005-188517 | A | 7/2005 |

OTHER PUBLICATIONS

The extended European Search Report of corresponding European Application No. 06833154.5 dated Mar. 26, 2010.

* cited by examiner

*Primary Examiner*—Edwin A. Leon
*Assistant Examiner*—Vanessa Girardi
(74) *Attorney, Agent, or Firm*—Global IP Counselors

(57) ABSTRACT

A terminal cover includes a claw portion and a covering portion. The claw portion is able to engage with an opening provided on a terminal guard that is arranged to stand around a terminal protruding outward from the casing of a compressor. The covering portion covers all pathways to the terminal from the opening when the claw portion is engaged with the opening.

8 Claims, 31 Drawing Sheets

COMPRESSOR TERMINAL COVER

CROSS-REFERENCE TO RELATED APPLICATIONS

This U.S. National stage application claims priority under 35 U.S.C. §119(a) to Japanese Patent Application No. 2005-340938 filed in Japan on Nov. 25, 2005, the entire contents of which are hereby incorporated herein by reference.

TECHNICAL FIELD

The present invention relates to a terminal cover and a terminal protective structure for protecting a terminal protruding outward from the casing of a compressor.

BACKGROUND ART

Conventionally, in order to protect a terminal 3 (refer to FIG. 16) protruding outward from the casing 2 of a compressor 1, a terminal guard 900 and a terminal cover 950 have been used as shown in FIGS. 22 and 27.

The terminal guard 900, as shown in FIGS. 22 to 26, is a guard that is made of metal and mainly formed by a bottom portion 910 having a first opening 911 in order for the terminal 3 to pass through and taking on a shape that follows the shape of the casing 2, and a first enclosing wall portion 920 that stands from the brim of the bottom portion 910. Here, the first enclosing wall portion 920 includes four wall portions of a first front wall portion 921, a first rear wall portion 924, a first left wall portion 922, and a first right wall portion 923. Second openings 931 that are circular for engaging with claw portions (to be described later) of the terminal cover 950 are each provided on the first left wall portion 922 and the first right wall portion 923. In addition, a first lead wire pass-through opening 932 is provided on the first front wall portion 921 for guiding a lead wire (not shown) that is connected with a terminal pin 4 of the terminal 3 outside the terminal guard 900.

As shown in FIGS. 27 to 32, the terminal cover 950 is a cover made of resin and roughly in a square shape, and is mainly formed by a roughly square upper wall portion 960 and a second enclosing wall portion 970 extending downward from the brim of the upper wall portion 960, and fits inside the terminal guard 900 described previously. Here, the second enclosing wall portion 970 includes four wall portions of a second front wall portion 971, a second rear wall portion 974, a second left wall portion 972, and a second right wall portion 973. Claw portions 981 are each provided on the second left wall portion 972 and the second right wall portion 973, approximately in the center in the width direction, and extending towards the lower end from approximately the center in the height direction. The claw portions 981 protrude out the second left wall portion 972 and the second right wall portion 973, and engage with the second openings 931 of the terminal guard 900 from the inner side of the terminal guard 900. In addition, a second lead wire pass-through opening 982 is provided on the second front wall portion 971 for guiding the lead wire connected with the terminal pin 4 of the terminal 3 outside the terminal cover 950.

A terminal protective body is formed as shown in FIGS. 33 and 34, when this terminal cover 950 engages with the terminal guard 900. With this terminal protective body, as it is clear in FIG. 33, almost the entire upper portion of the second opening 931 of the terminal guard 900 is covered by the second left wall portion 972 or the second right wall portion 973 of the terminal cover 950, but a little gap W is formed on the lower portion of the second opening 931.

SUMMARY OF THE INVENTION

Object to be Achieved by the Invention

Meanwhile, when removing this kind of a terminal cover 950 from the terminal guard 900, a lot of people will insert a jig used for the removal (for example, a minus driver, and the like) into the gap W, and force the terminal cover 950 in the opposite direction from the engaging direction or push back the claw portions 981 with the jig used for the removal. However, a person might hit the jig used for the removal on the terminal with all his strength and accidentally harm the terminal with the jig used for the removal.

An object of the present invention is to provide a terminal cover and a terminal protective structure with which a person intending to remove the terminal cover can remove the terminal cover successfully without damaging the terminal.

Means for Achieving the Object

The terminal cover according to a first aspect of the present invention includes a claw portion and a covering portion. The claw portion is able to engage with an opening provided on a terminal guard that is arranged to stand around a terminal protruding outward from the casing of a compressor. The covering portion covers all pathways to the terminal from the opening, when the claw portion is engaged with the opening.

With this terminal cover, all pathways to the terminal from the opening when the claw portion is engaged with the opening are covered by the covering portion. Therefore, a person intending to remove this terminal cover can remove the terminal cover successfully without damaging the terminal.

The terminal cover according to a second aspect of the present invention is the terminal cover as set forth in the first aspect, wherein the claw portion is mounted on the covering portion.

With this terminal cover, the claw portion is mounted on the covering portion. For this reason, this terminal cover can be manufactured with a smaller amount of resin, compared to if the claw portion and the covering portion are provided separately.

The terminal cover according to a third aspect of the present invention is the terminal cover as set forth in the first aspect, wherein the covering portion is provided separately from the claw portion, and is positioned between the claw portion and the terminal when the claw portion is engaged with the opening.

With this terminal cover, the covering portion is provided separately from the claw portion, and is positioned between the claw portion and the terminal when the claw portion is engaged with the opening. For this reason, force can be exerted from below the claw portion, and this terminal cover can be removed even more easily from the terminal guard.

The terminal cover according to a fourth aspect of the present invention is the terminal cover as set forth in any of the first to the third aspects, wherein the claw portion includes a first wall portion. The first wall portion is orthogonal to the engaging direction with the opening. In addition, this claw portion engages from the inner side of the terminal guard.

With this terminal cover, the claw portion includes a first wall portion, and engages from the inner side of the terminal guard. For this reason, this terminal cover can be drawn out from the terminal guard with a smaller force than before, by exerting a force through a jig, used for the removal, on the first wall portion, in the direction opposite the engaging direction (drawing direction).

The terminal cover according to a fifth aspect of the present invention is the terminal cover as set forth in the fourth aspect, wherein the claw portion includes second wall portions. The second wall portions are two walls extending towards the engaging direction from the two end portions of the first wall portion.

With this terminal cover, the claw portion includes the second wall portions. Thus, when this terminal cover is drawn out from the terminal guard in the opposite direction from the engaging direction (drawing direction), the jig used for the removal can be prevented from going off in a direction orthogonal to the two directions of the engaging direction and the standing direction of the walls (the first wall portion and the second wall portions). Therefore, this terminal cover can be drawn out even more easily from the terminal guard.

The terminal cover according to a sixth aspect of the present invention is the terminal cover as set forth in the fifth aspect, wherein the claw portion includes a second surface, which is a surface orthogonal to the standing direction of the second wall portions between the second wall portions. In addition, here, the standing direction of the second wall portions is orthogonal to the engaging direction.

With this terminal cover, the claw portion includes a second surface, which is a surface orthogonal to the standing direction of the second wall portions between the second wall portions. Thus, it becomes easy to press the claw portion in the opposite direction from the protruding direction, and this terminal cover can be removed easily from the terminal guard.

The terminal cover according to a seventh aspect of the present invention is the terminal cover as set forth in the fifth aspect or the sixth aspect, wherein an end surface of the second wall portions on the protruding side of the claw portion slopes towards the covering portion, following towards the engaging direction from the first wall portion.

With this terminal cover, end surface on the protruding side of the claw portion of the second wall portions slopes towards the covering portion, following towards the engaging direction from the first wall portion. Thus, it becomes easy to fit this terminal cover in the terminal guard.

The terminal cover according to an eighth aspect of the present invention is the terminal cover as set forth in any of the first to the seventh aspects, wherein the terminal cover further includes slits. The slits extend towards the engaging direction. The slits are arranged near the claw portion so as to sandwich the claw portion.

This terminal cover further includes slits. For this reason, with this terminal cover, it becomes easy to draw the claw portion out in the opposite direction from the protruding direction, and this terminal cover can be removed easily from the terminal guard.

The terminal cover according to a ninth aspect of the present invention is the terminal cover as set forth in any of the fourth to the eighth aspects, wherein the first wall portion includes a first surface, which is a surface orthogonal to the engaging direction. In addition, a fifth surface of the opening, which is the surface on the entering side of the claw portion, is orthogonal to the engaging direction.

With this terminal cover, the first wall portion includes a first surface, and a fifth surface of the opening, which is a surface on the entering side of the claw portion, is orthogonal to the engaging direction. For this reason, this terminal cover is fixed stably when being fit in the terminal guard.

The terminal protective structure according to a tenth aspect of the present invention includes a terminal guard and a terminal cover. The terminal guard is arranged to stand around a terminal protruding outward from the casing of a compressor. In addition, this terminal guard has an opening. The terminal cover includes a claw portion and a covering portion. The claw portion is able to engage with the opening. The covering portion covers all pathways to the terminal from the opening when the claw portion is engaged with the opening.

With this terminal protective structure, when the claw portion is engaged with the opening, the covering portion covers all pathways to the terminal from the opening. For this reason, with this terminal protective structure, a person intending to remove the terminal cover is able to remove the terminal cover without damaging the terminal.

Effects of the Invention

The terminal cover according to the first aspect of the present invention can be removed by a person who intends to remove it successfully without harming the terminal.

The terminal cover according to the second aspect of the present invention can be manufactured with a smaller amount of resin compared to if the claw portion and the covering portion are provided separately.

With the terminal cover according to the third aspect of the present invention, a force can be exerted in the opposite direction from the engaging direction from below the claw portion, and it becomes even easier to remove the terminal cover from the terminal guard.

The terminal cover according to the fourth aspect of the present invention can be drawn out from the terminal guard with a smaller force than before, by exerting a force through a jig, used for the removal, on the first wall portion, in the direction opposite the engaging direction (drawing direction).

When the terminal cover according to the fifth aspect of the present invention is drawn out from the terminal guard in the direction opposite the engaging direction (drawing direction), the jig used for the removal can be prevented from going off into a direction orthogonal to the two directions of the engaging direction and the rising direction of the walls (the first wall portion and the second wall portions). Therefore, this terminal cover can be drawn out even more easily from the terminal guard.

With the terminal cover according to the sixth aspect of the present invention, it becomes easy to press the claw portion to the opposite direction from the protruding direction, and the terminal cover can be removed easily from the terminal guard.

The terminal cover according to the seventh aspect of the present invention can easily fit in the terminal guard.

With the terminal cover according to the eighth aspect of the present invention, it becomes easy to draw the claw portion back in the opposite direction from the protruding direction, and the terminal cover can be removed easily from the terminal guard.

The terminal cover according to the ninth aspect of the present invention is fixed stably when being fitted in the terminal guard.

With the terminal protective structure according to the tenth aspect of the present invention, a person intending to remove the terminal cover can remove the terminal cover without damaging the terminal.

BRIEF DESCRIPTION OF THE DRAWINGS

FIG. 35(*a*) is a front view of the claw portion, and FIG. 35(*b*) is a side view of the claw portion.

DETAILED DESCRIPTION OF THE INVENTION

Here, a terminal protective body of a compressor 1 according to an embodiment of the present invention will be described using FIGS. 1 to 15, 35(*a*) and 35(*b*).

Figure 1:
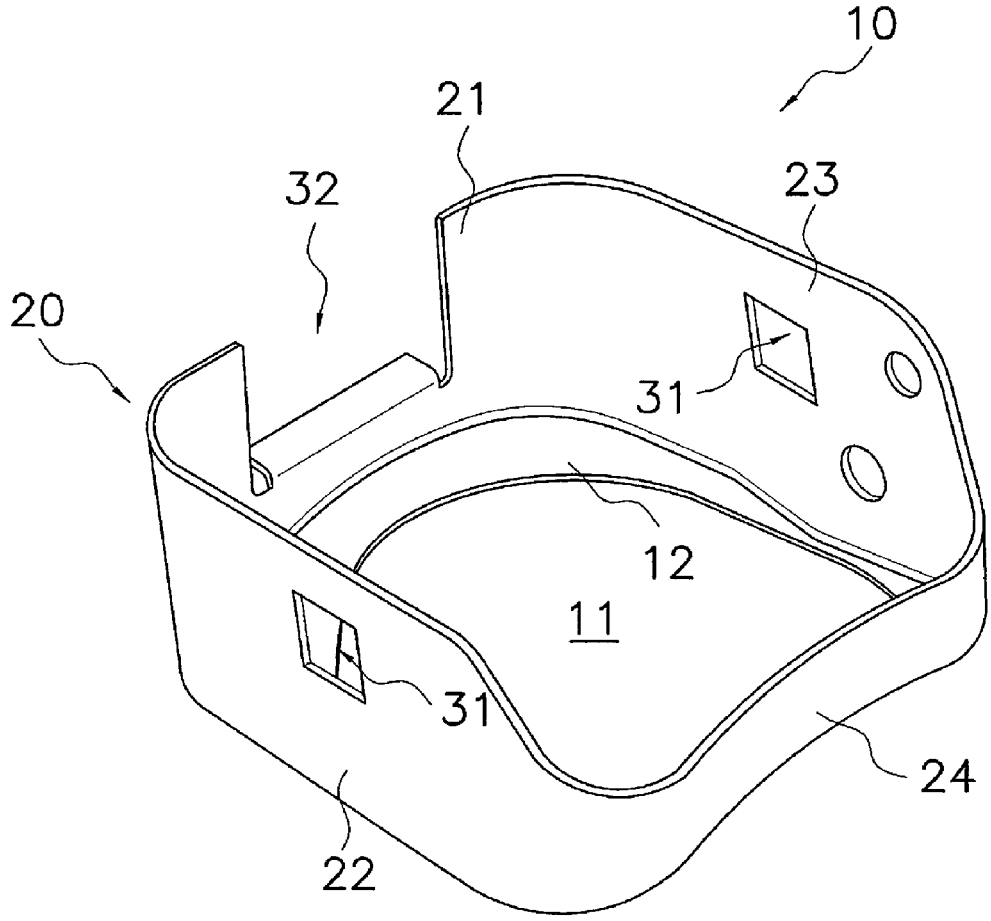
FIG. 1 is an appearance perspective view of a terminal guard according to an embodiment of the present invention.
Figure 2:
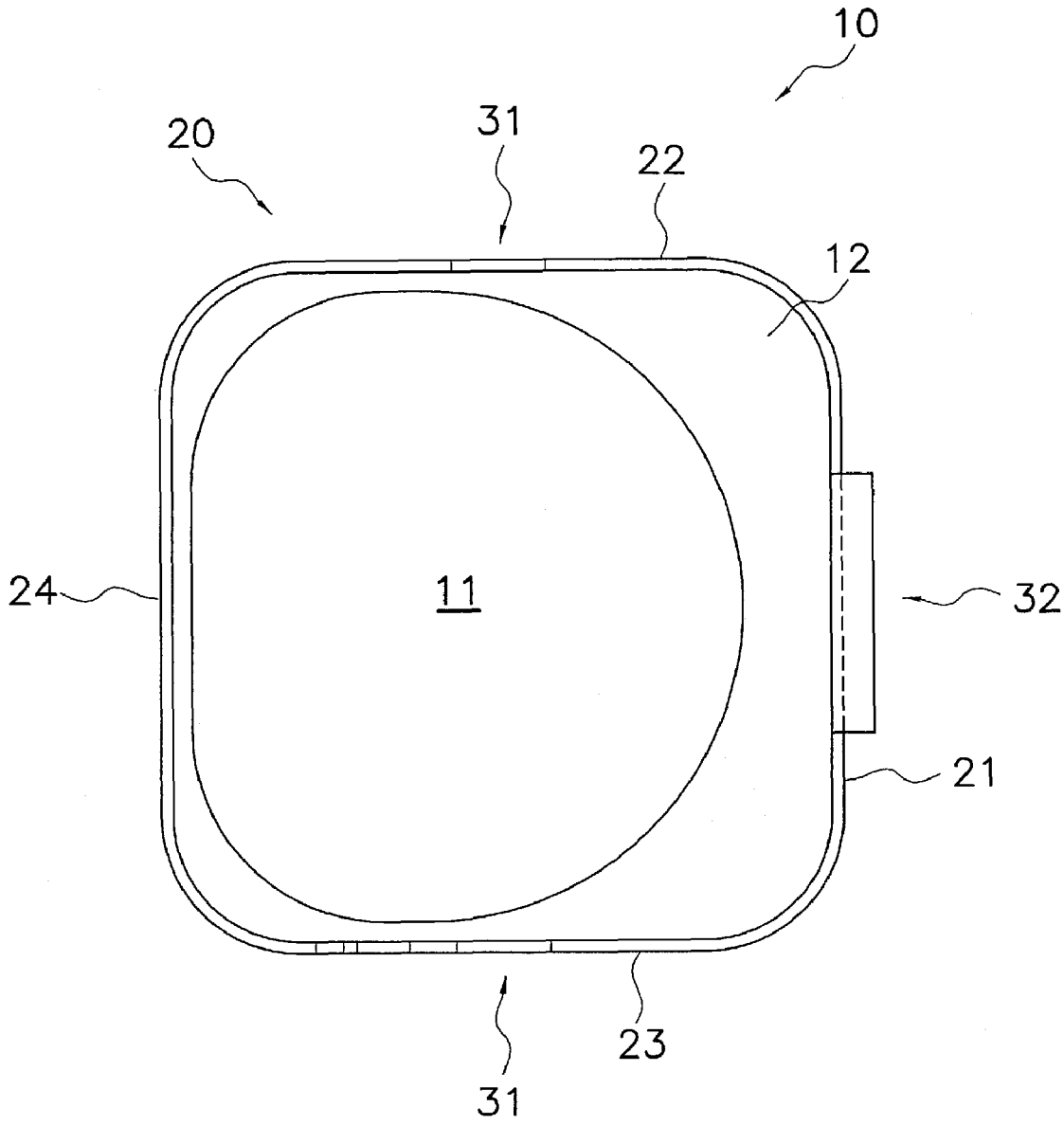
FIG. 2 is a top view of the terminal guard according to the embodiment of the present invention.
Figure 3:
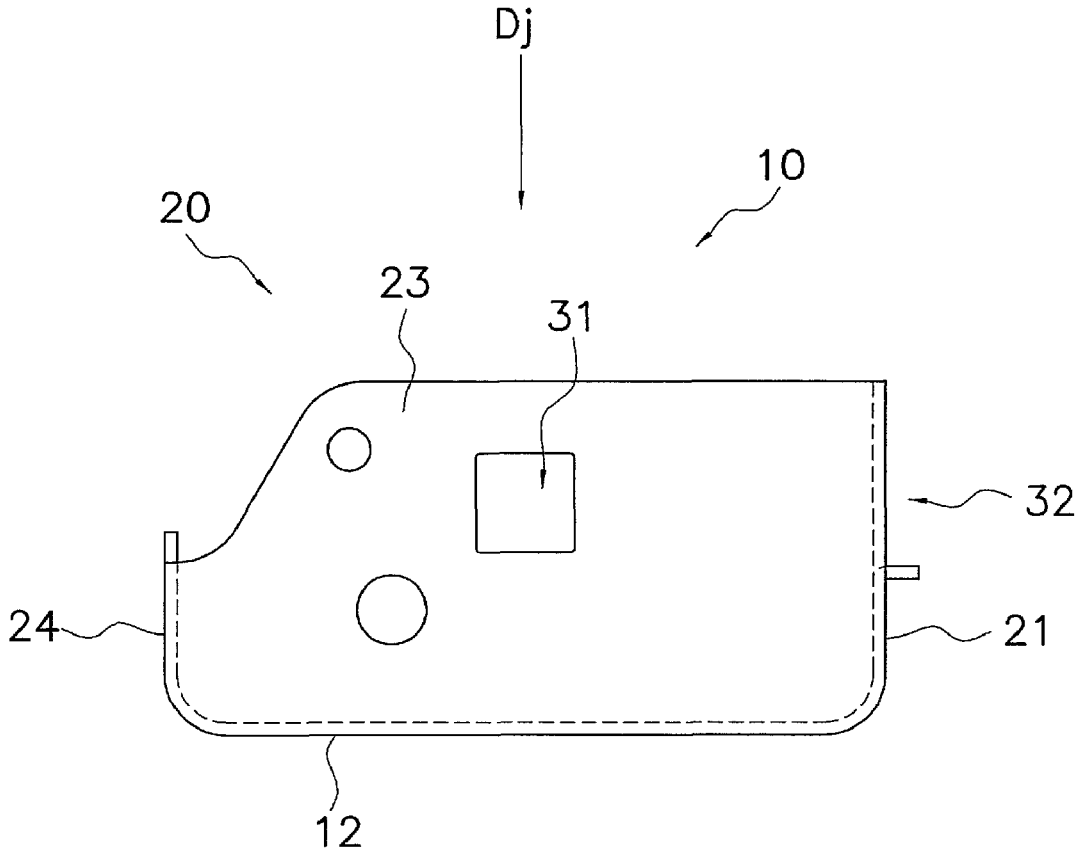
FIG. 3 is a right side view of the terminal guard according to the embodiment of the present invention.
Figure 4:
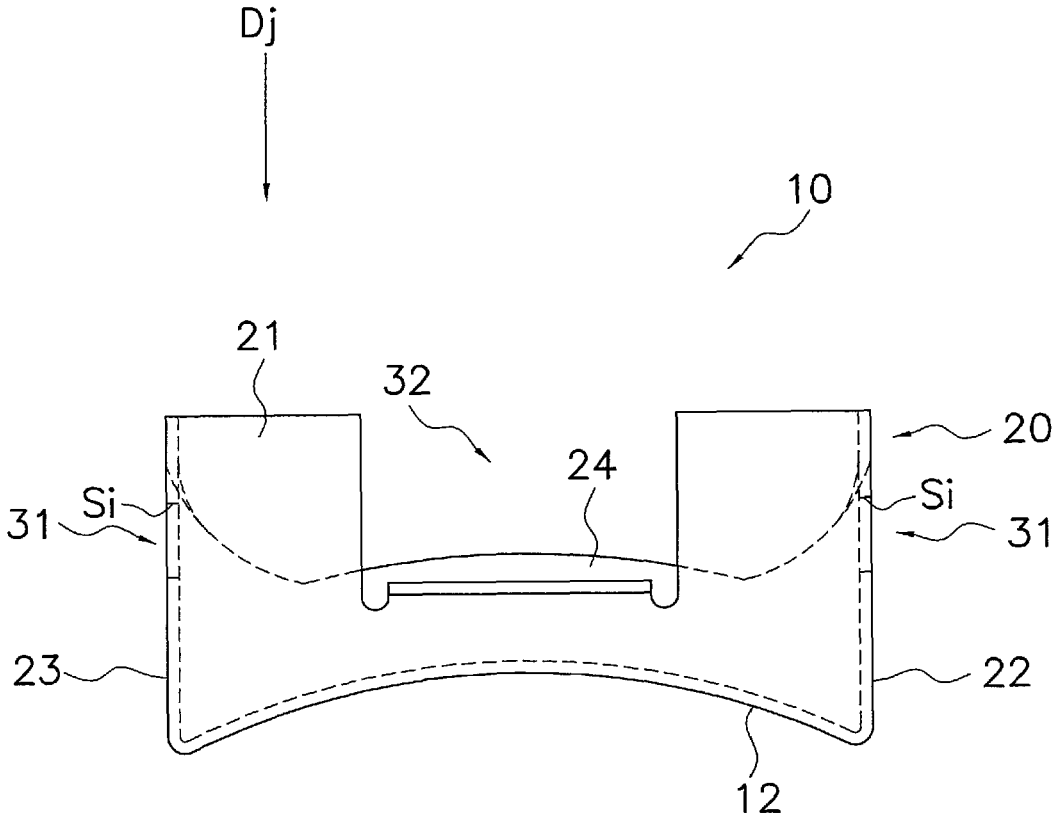
FIG. 4 is a front view of the terminal guard according to the embodiment of the present invention.
Figure 5:
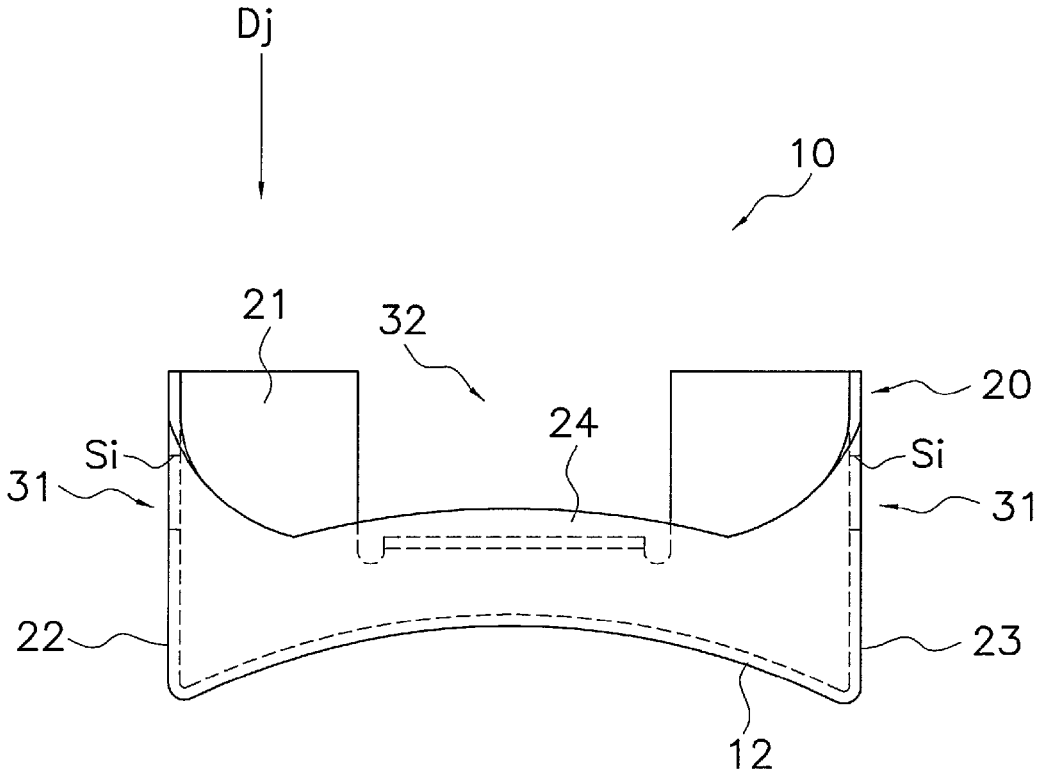
FIG. 5 is a rear view of the terminal guard according to the embodiment of the present invention.
Figure 6:
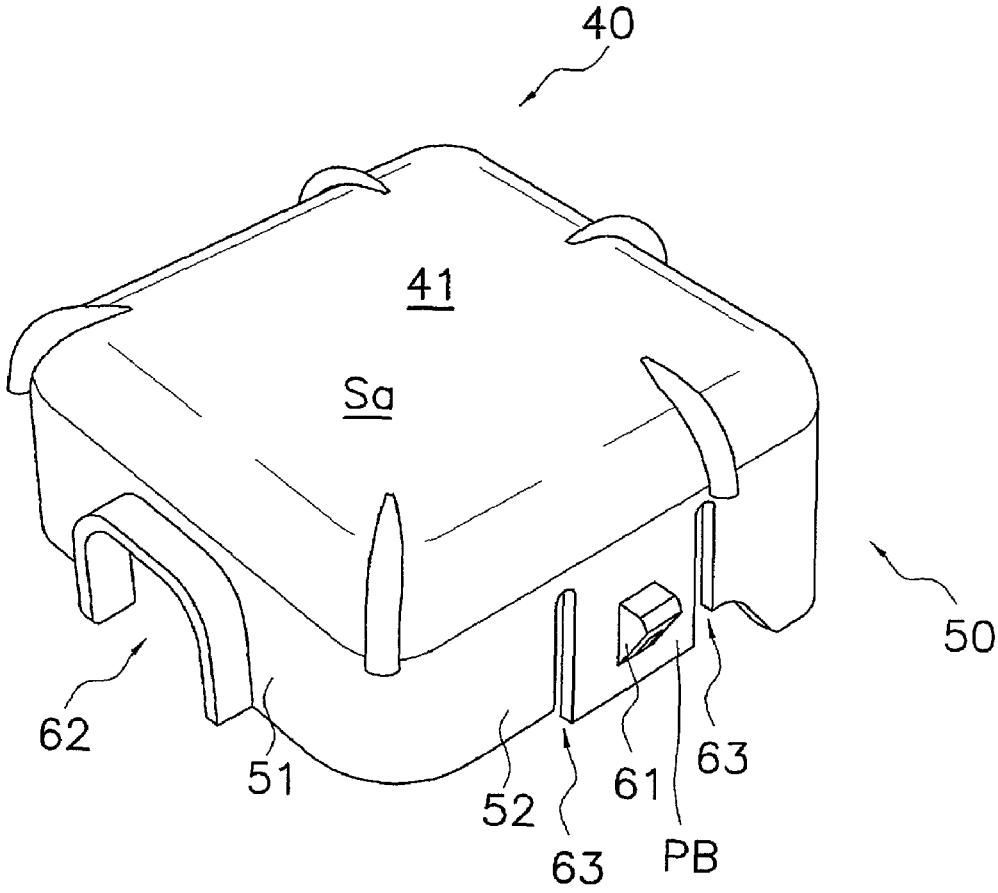
FIG. 6 is an appearance perspective view of a terminal cover according to the embodiment of the present invention.
Figure 7:
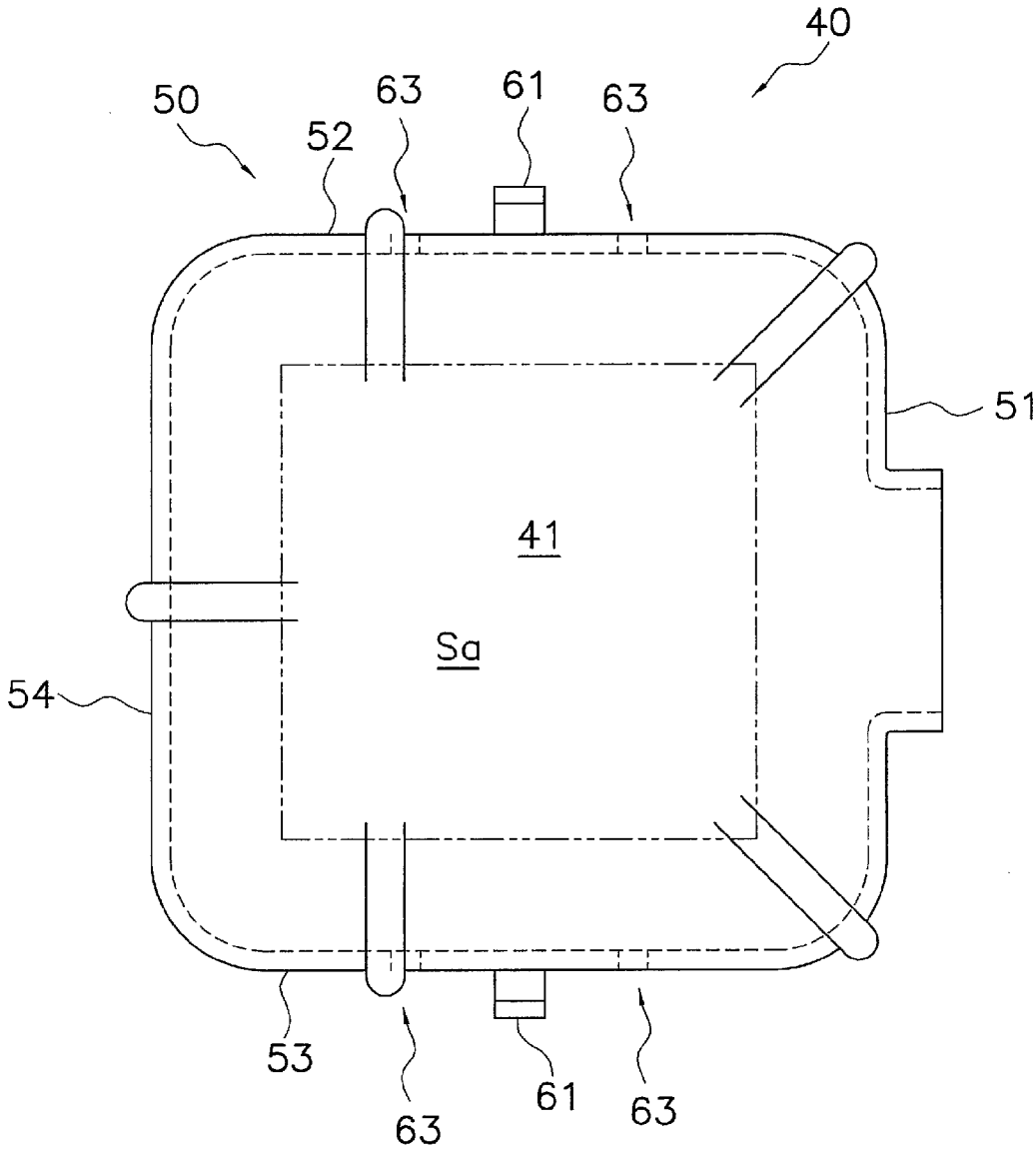
FIG. 7 is a top view of the terminal cover according to the embodiment of the present invention.
Figure 8:
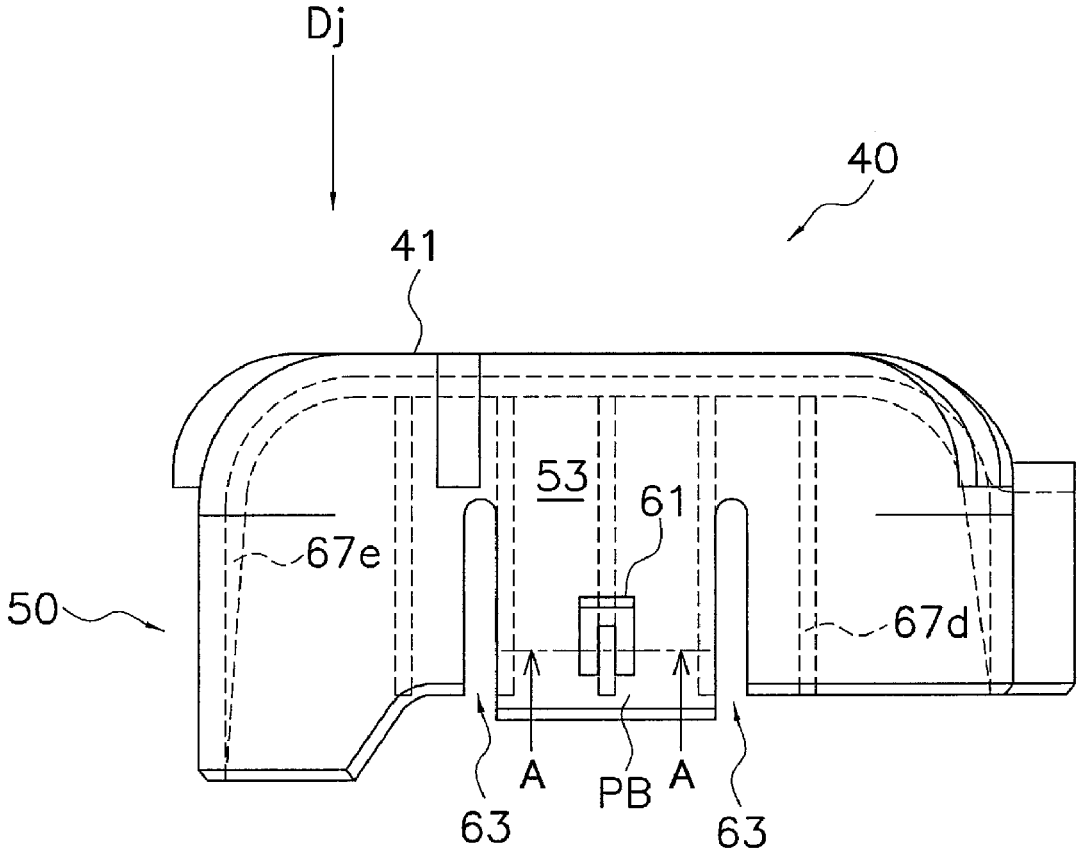
FIG. 8 is a right side view of the terminal cover according to the embodiment of the present invention.
Figure 9:
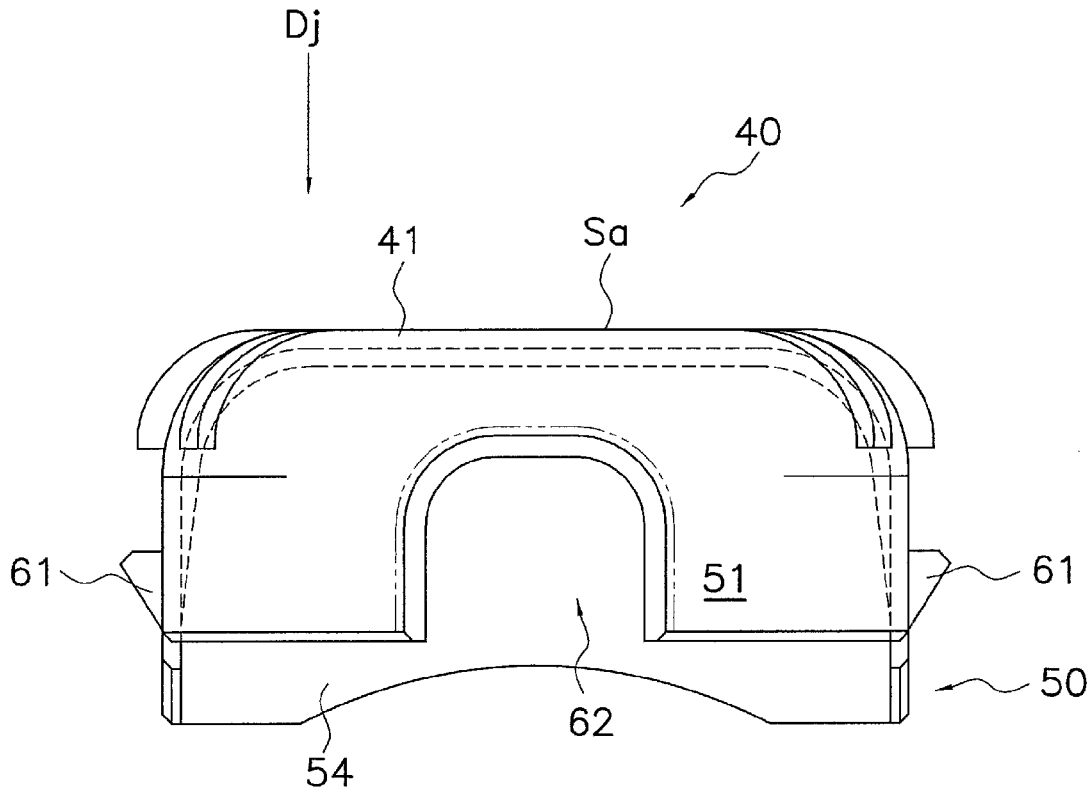
FIG. 9 is a front view of the terminal cover according to the embodiment of the present invention.
Figure 10:
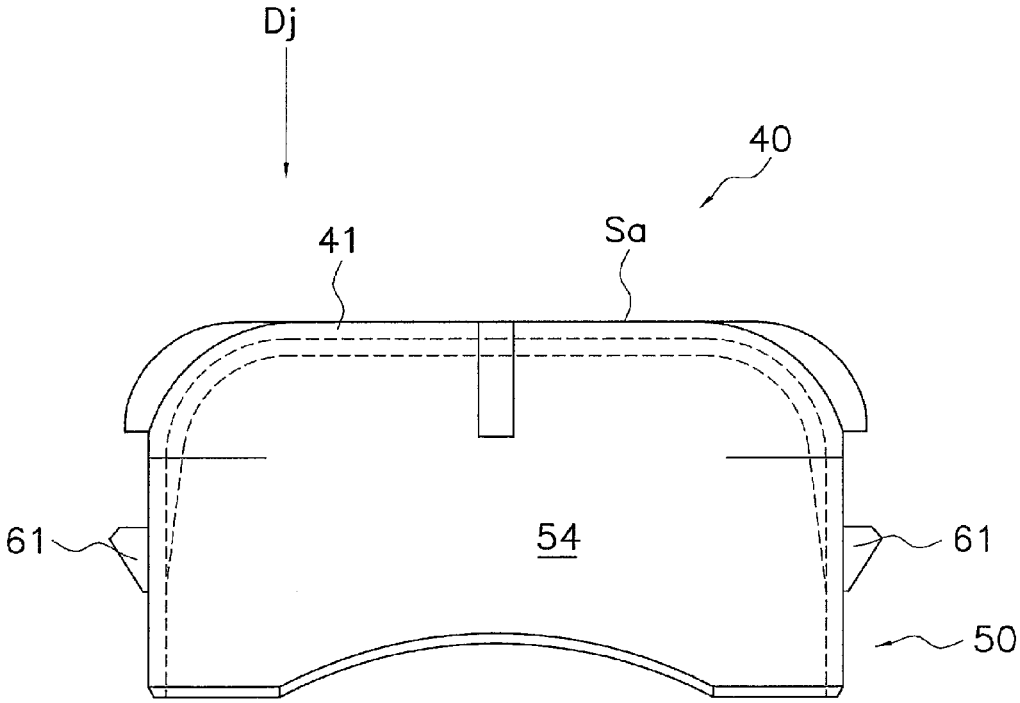
FIG. 10 is a rear view of the terminal cover according to the embodiment of the present invention.
Figure 11:
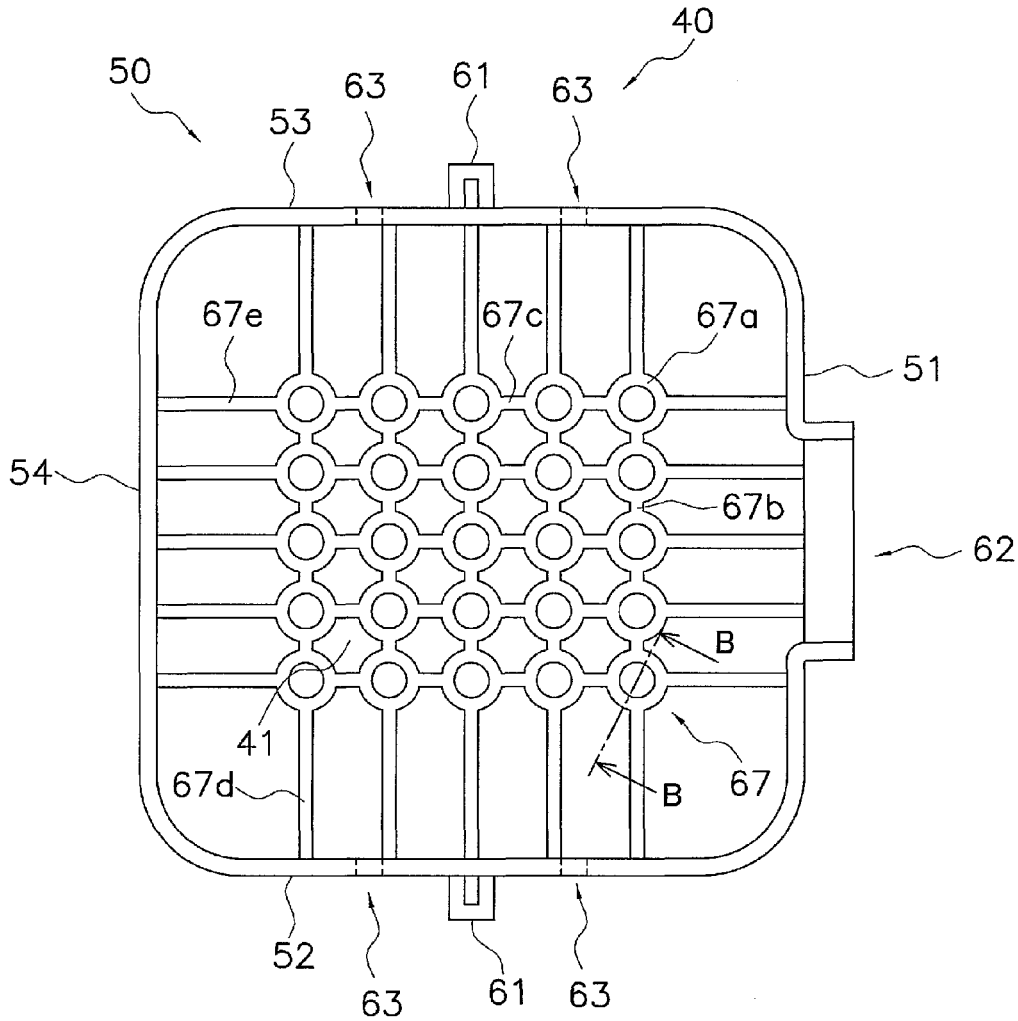
FIG. 11 is a diagram showing the underside surface of the terminal cover according to the embodiment of the present invention.
Figure 12:
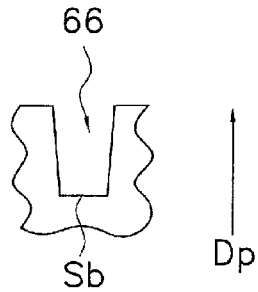
FIG. 12 is a section A-A of a claw portion of the terminal cover according to the embodiment of the present invention.
Figure 13:
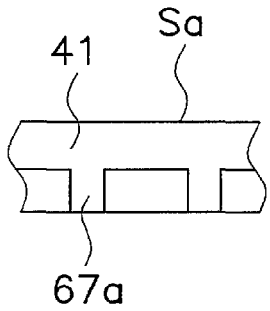
FIG. 13 is a section B-B of a reinforcing rib of the terminal cover according to the embodiment of the present invention.
Figure 14:
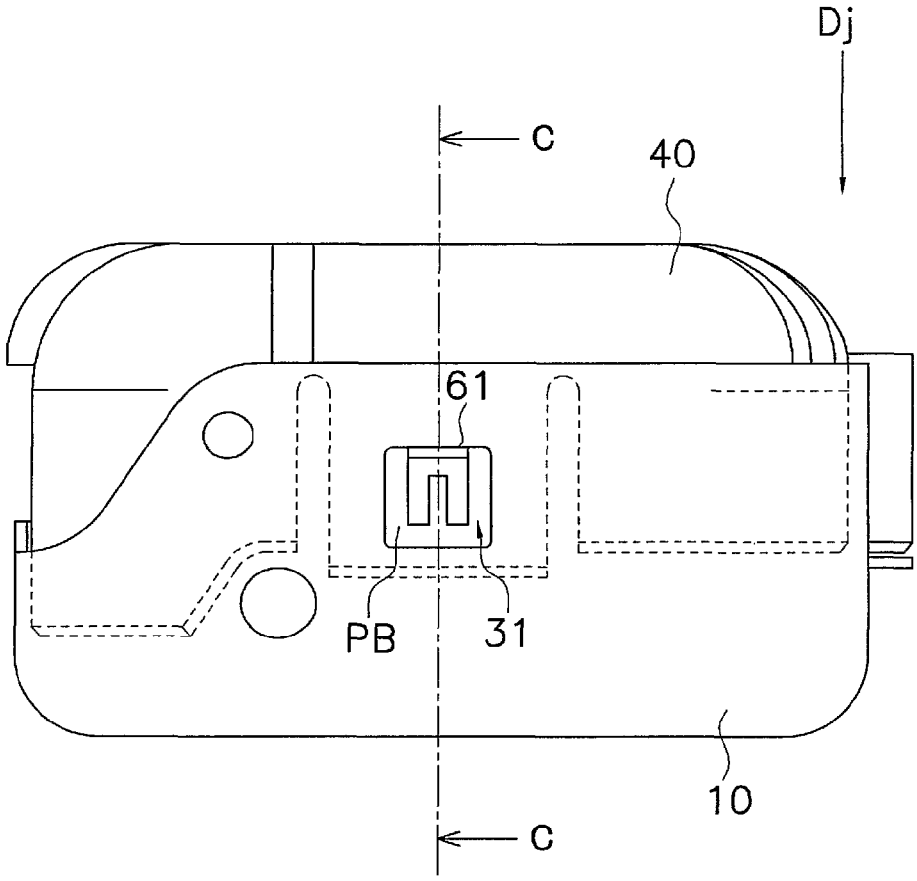
FIG. 14 is a right side view showing when the terminal cover according to the embodiment of the present invention is engaged with the terminal guard according to the embodiment of the present invention.
Figure 15:
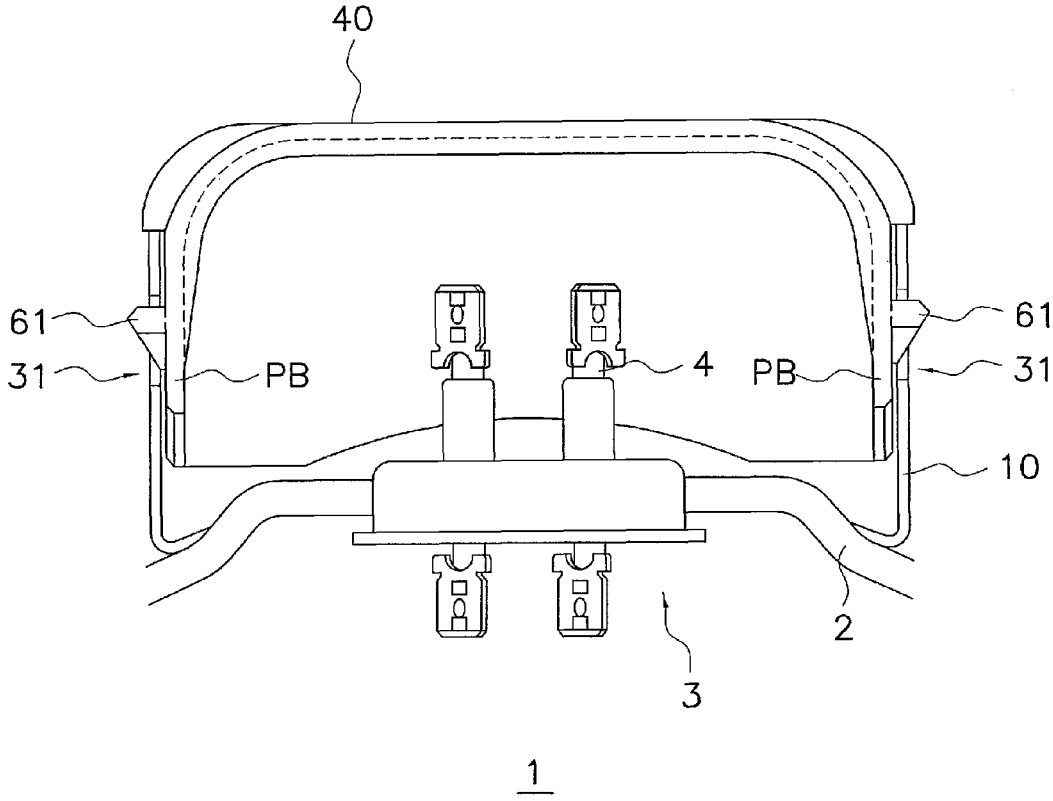
FIG. 15 is a section C-C showing when the terminal cover according to the embodiment of the present invention is engaged with the terminal guard according to the embodiment of the present invention.
Figure 35A:
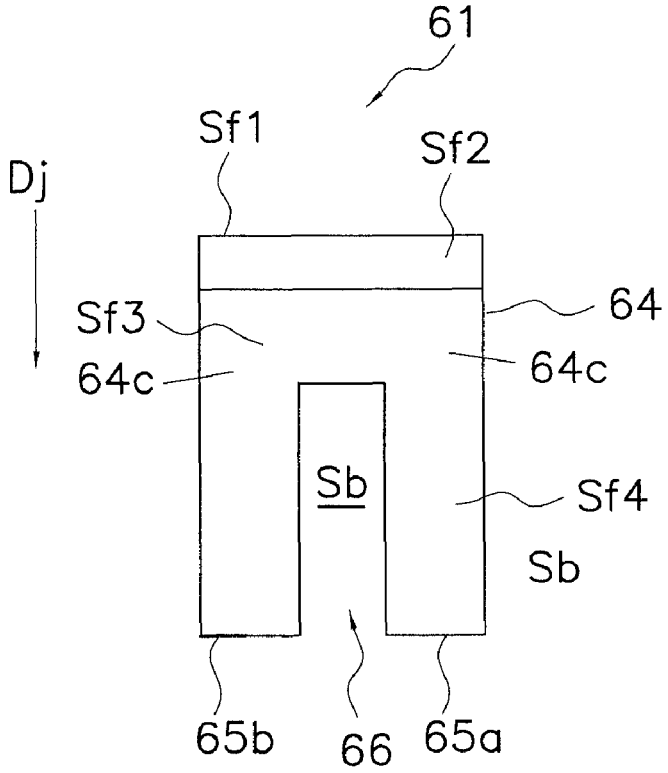
FIGS. 35(*a*) and 35(*b*) are enlarged diagrams of the claw portion adopted in the terminal cover according to the embodiment of the present invention.
Figure 35B:
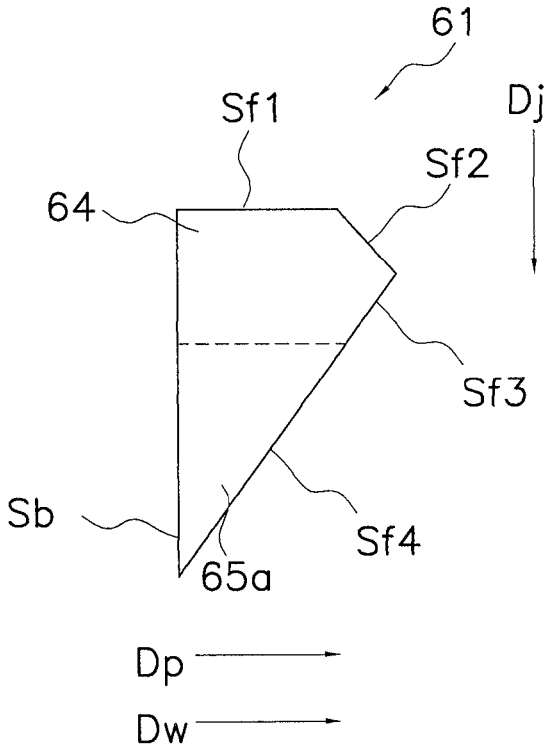

In addition, here, FIG. 1 is an appearance perspective view of a terminal guard according to the embodiment of the present invention. FIG. 2 is a top view of the terminal guard according to the embodiment of the present invention. FIG. 3 is a side view of the terminal guard according to the embodiment of the present invention. FIG. 4 is a front view of the terminal guard according to the embodiment of the present invention. FIG. 5 is a rear view of the terminal guard according to the embodiment of the present invention. FIG. 6 is an appearance perspective view of a terminal cover according to the embodiment of the present invention. FIG. 7 is a top view of the terminal cover according to the embodiment of the present invention. FIG. 8 is a side view of the terminal cover according to the embodiment of the present invention. FIG. 9 is a front view of the terminal cover according to the embodiment of the present invention. FIG. 10 is a rear view of the terminal cover according to the embodiment of the present invention. FIG. 11 is a bottom view of the terminal cover according to the embodiment of the present invention. FIG. 12 shows a section A-A of a claw portion of the terminal cover according to the embodiment of the present invention. FIG. 13 shows a section B-B of a reinforcing rib of the terminal cover according to the embodiment of the present invention. FIG. 14 is a side view showing when the terminal cover is engaged with the terminal guard according to the embodiment of the present invention. FIG. 15 shows a section C-C showing when the terminal cover is engaged with the terminal guard according to the embodiment of the present invention. FIGS. 35(*a*) and 35(*b*) are enlarged diagrams of the claw portion adopted in the terminal cover according to the embodiment of the present invention.

Terminal Protective Body

The terminal protective body of a compressor 1 according to the embodiment of the present invention is formed from a terminal guard 10 and a terminal cover 40, as shown in FIGS. 14 and 15.

The terminal guard 10 and the terminal cover 40 will each be described in detail below.

(1) Terminal Guard

Figure 16:
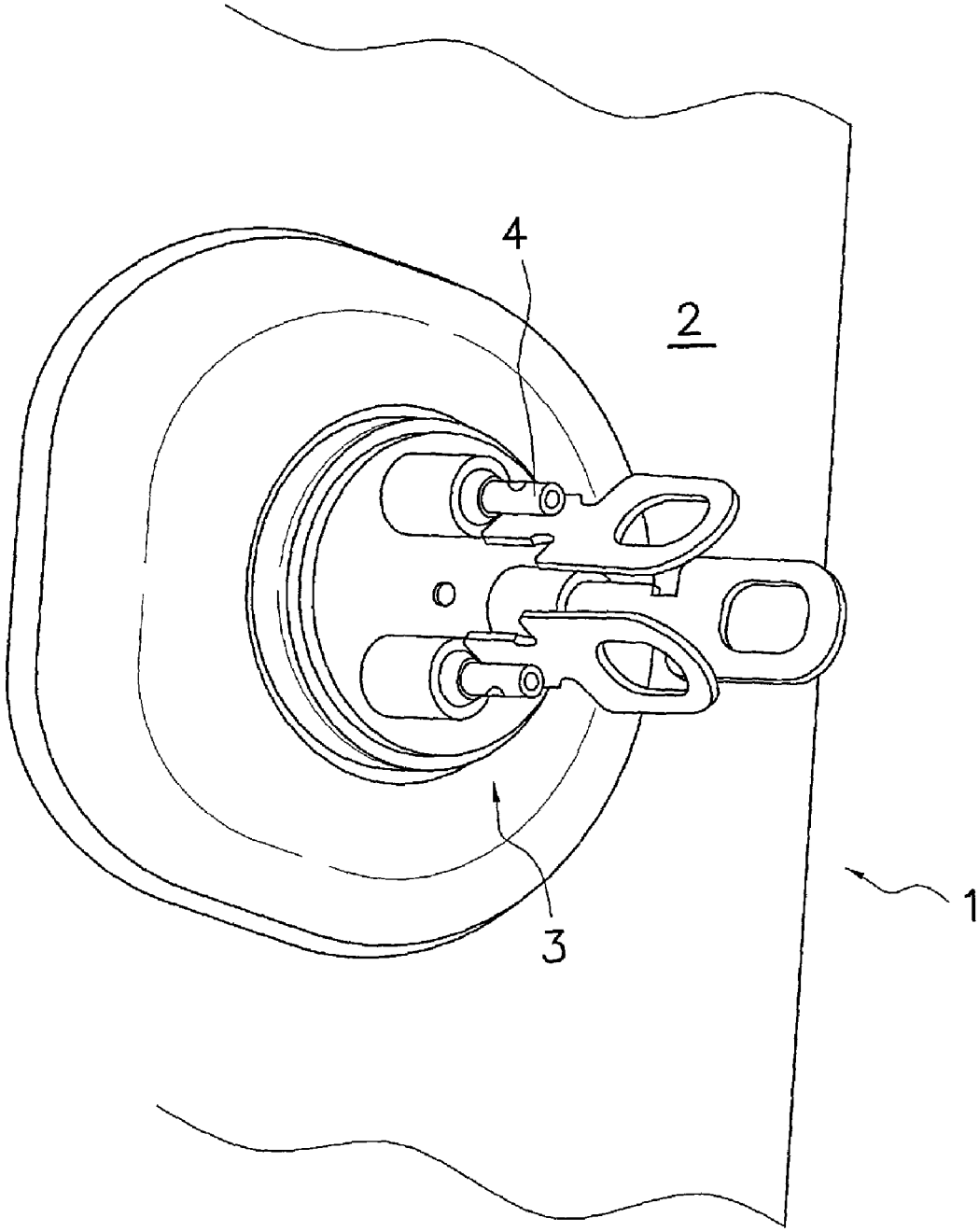
FIG. 16 is an appearance perspective view of a terminal protruding outward from a compressor.
Figure 17:
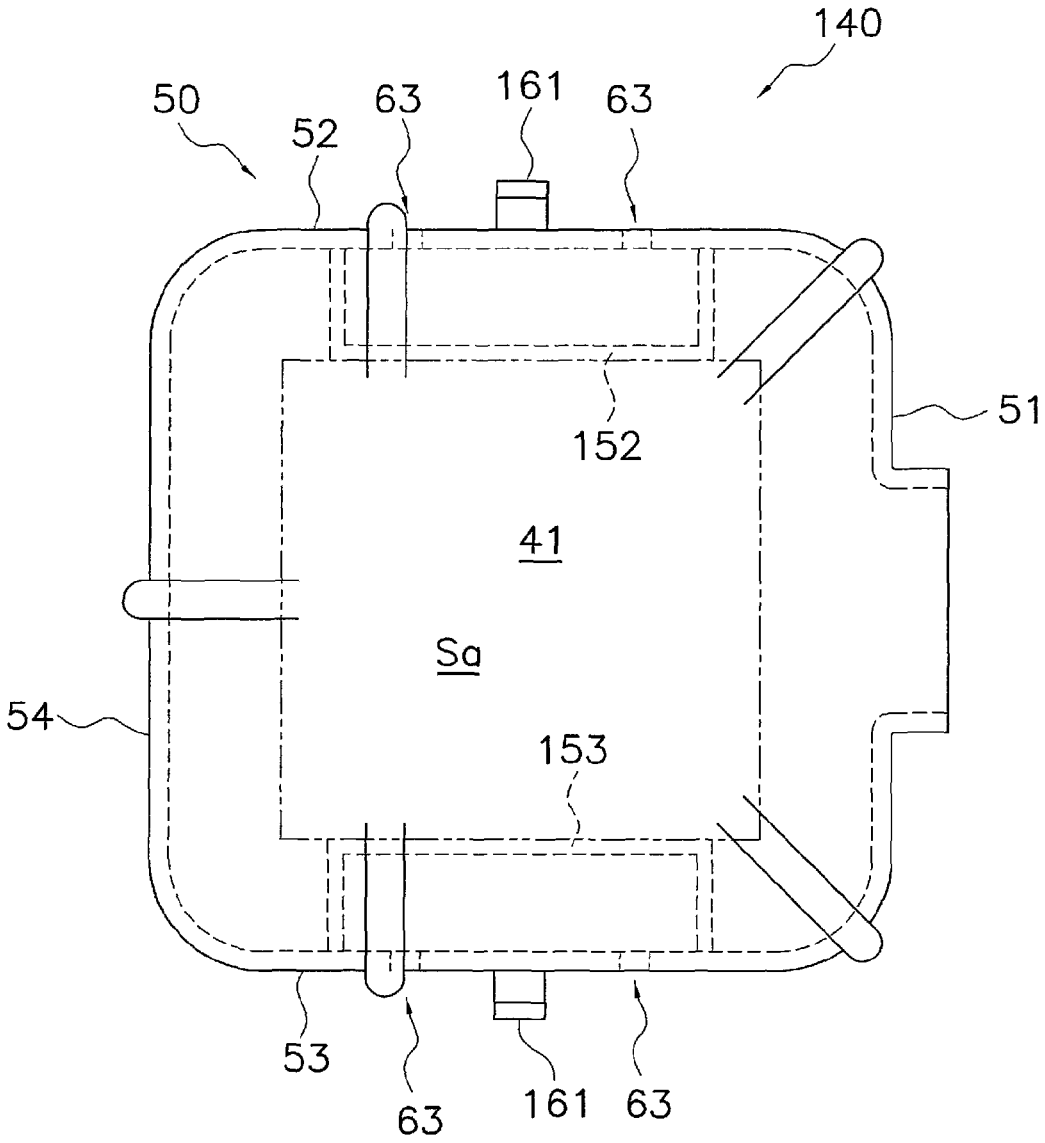
FIG. 17 is a top view of a terminal cover according to Modification Example (A)
Figure 18:
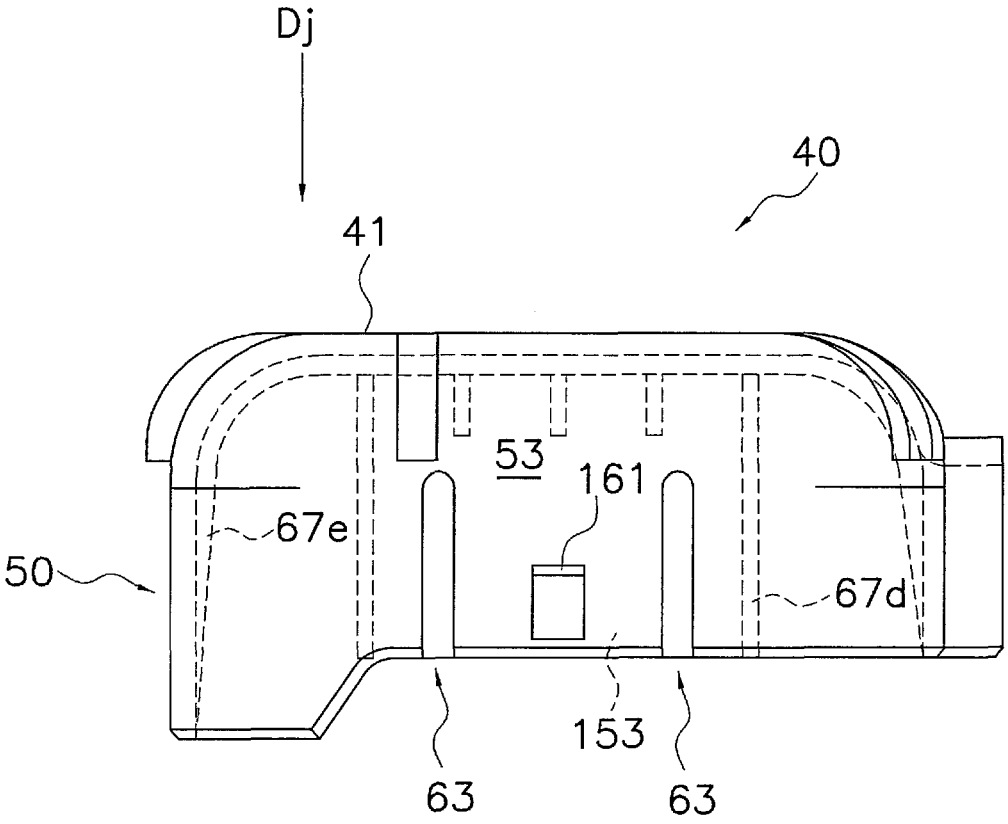
FIG. 18 is a right side view of the terminal cover according to Modification Example (A)
Figure 19:
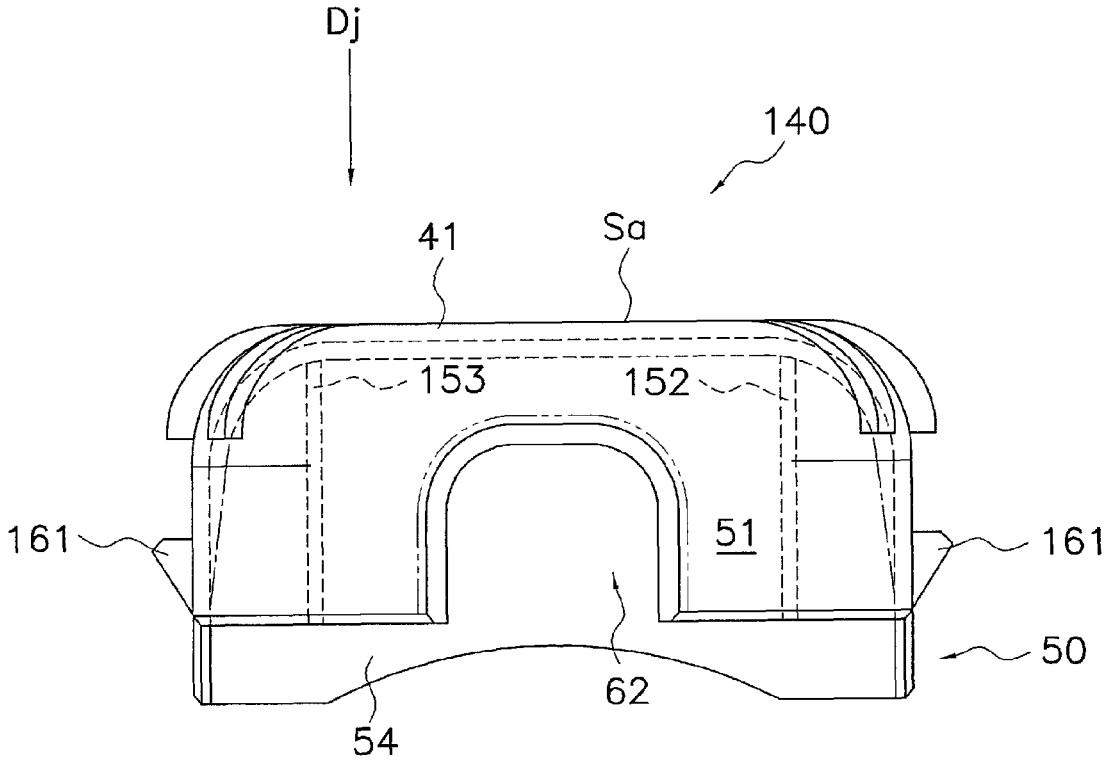
FIG. 19 is a front view of the terminal cover according to Modification Example (A)
Figure 20:
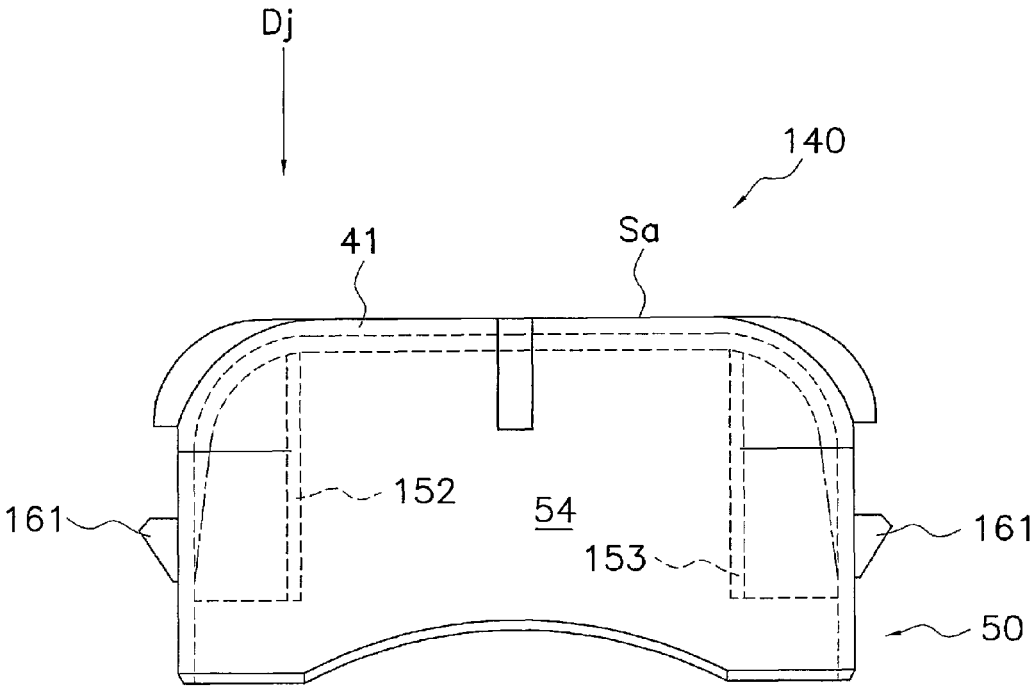
FIG. 20 is a rear view of the terminal cover according to Modification Example (A)
Figure 21:
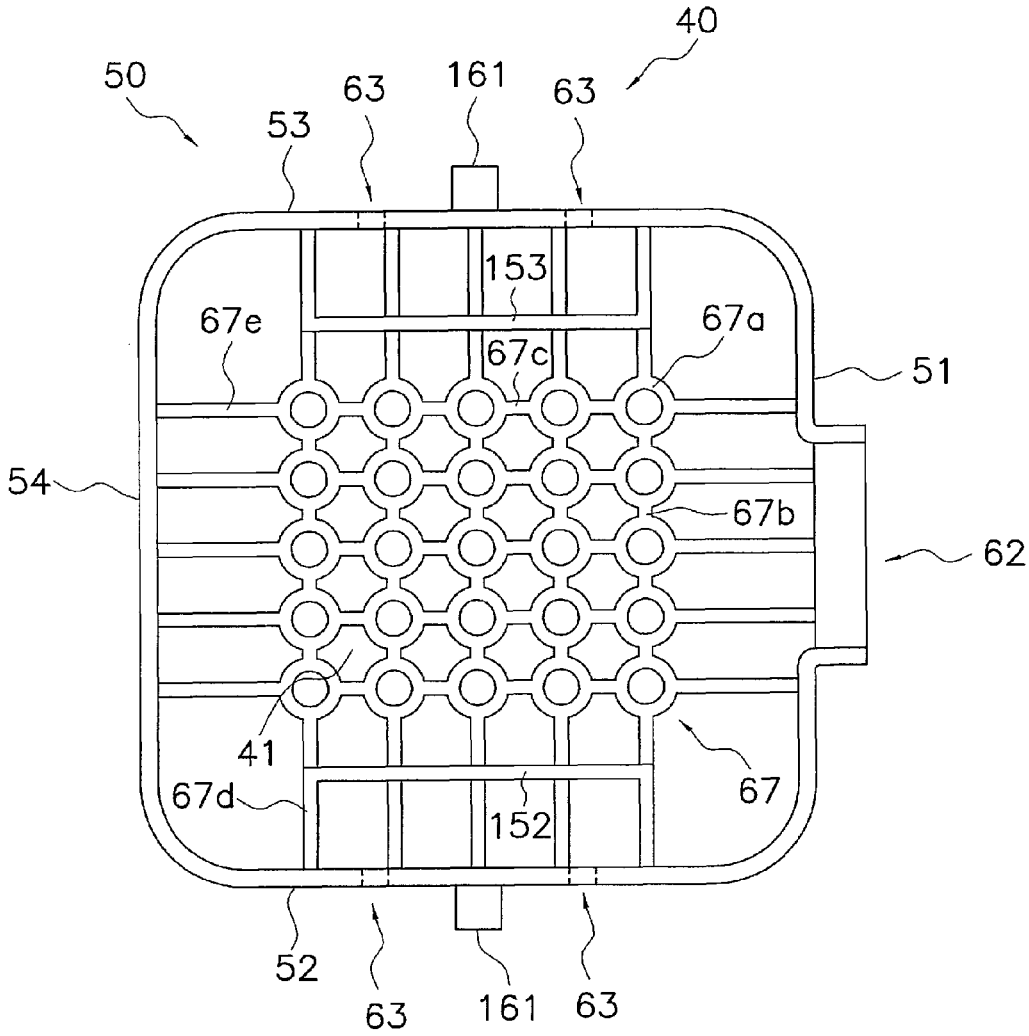
FIG. 21 is a diagram showing the underside surface of the terminal cover according to Modification Example (A)
Figure 22:
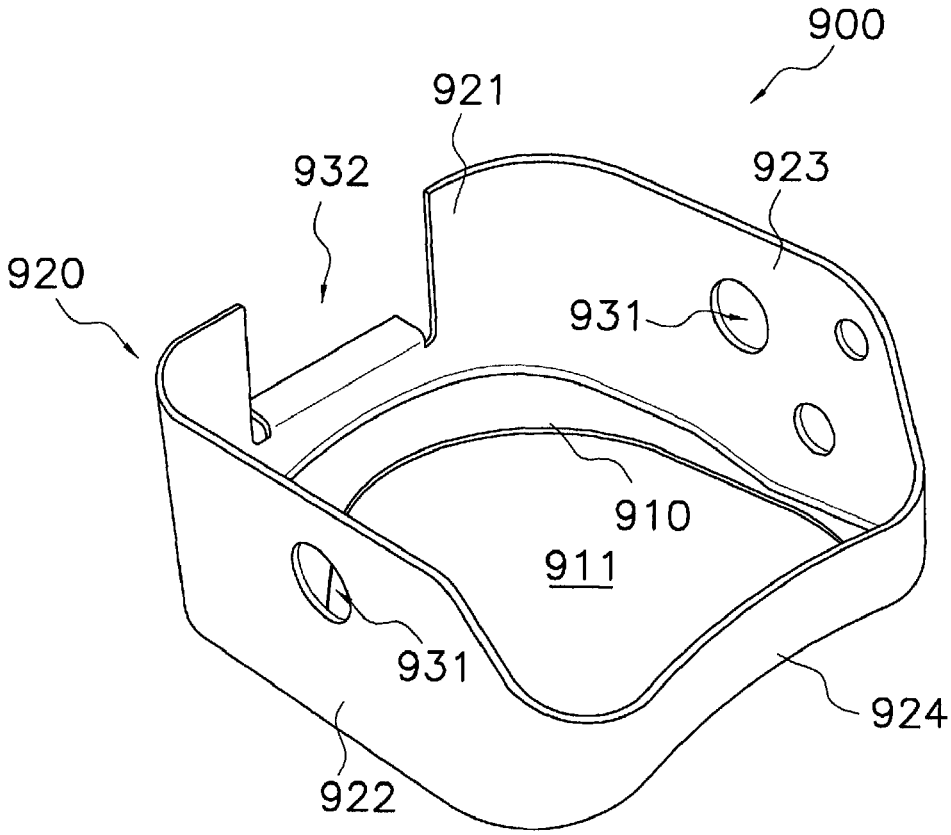
(Prior Art) Fig. 22
FIG. 22 is an appearance perspective view of a conventional terminal guard.
Figure 23:
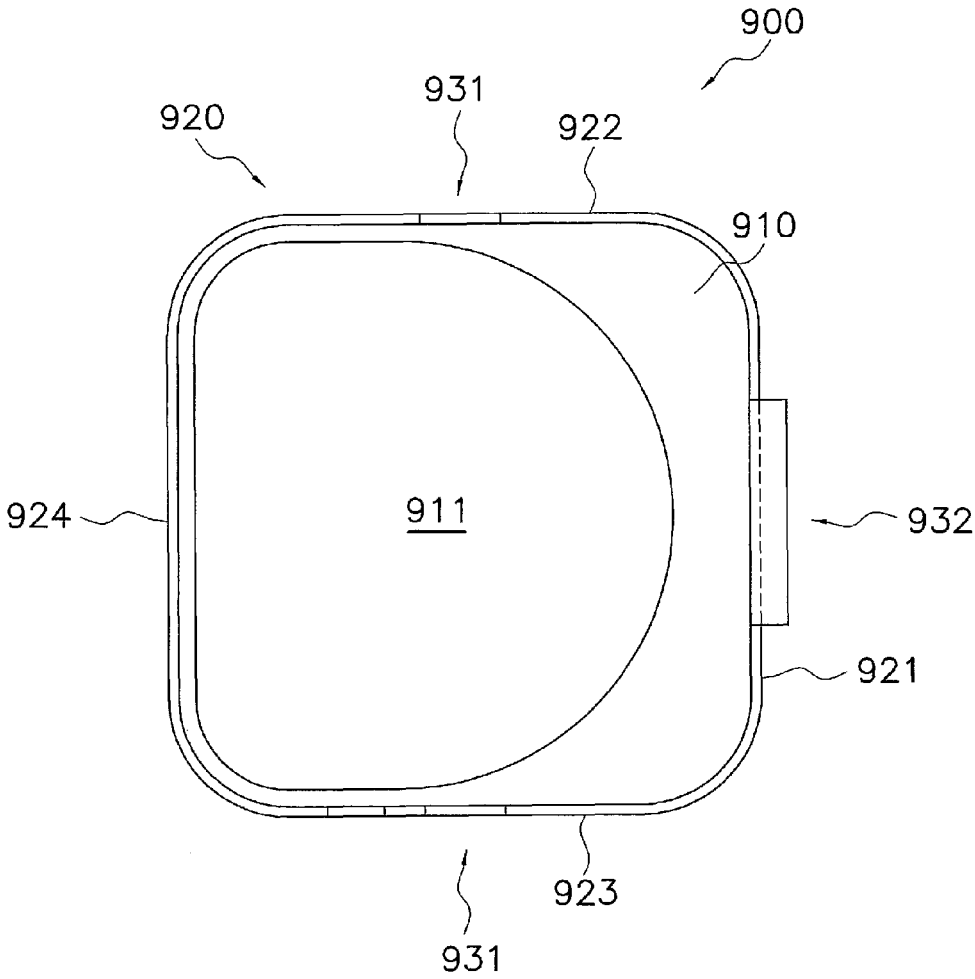
(Prior Art) Fig. 23
FIG. 23 is a top view of the conventional terminal guard.
Figure 24:
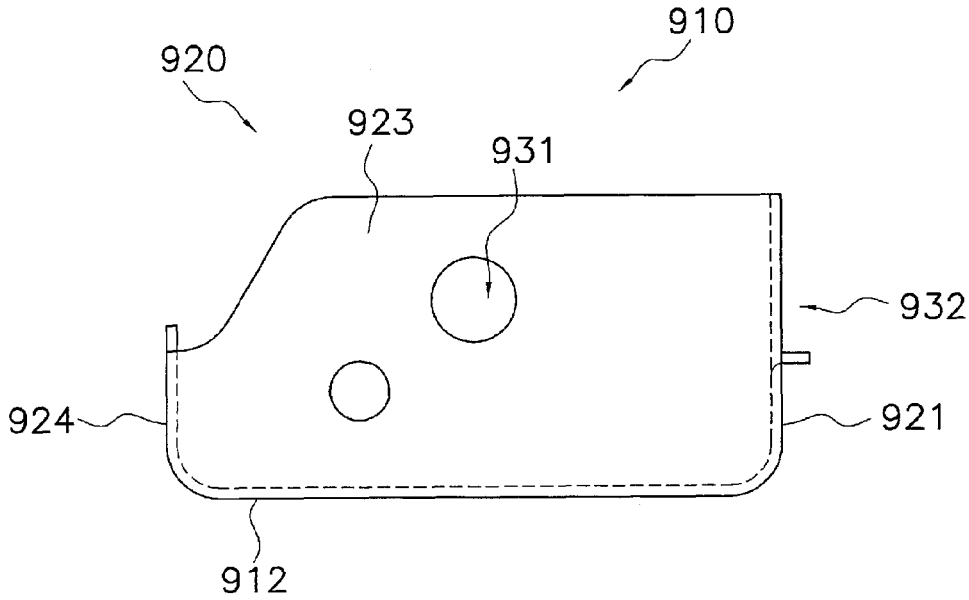
(Prior Art) Fig. 24
FIG. 24 is a right side view of the conventional terminal guard.
Figure 25:
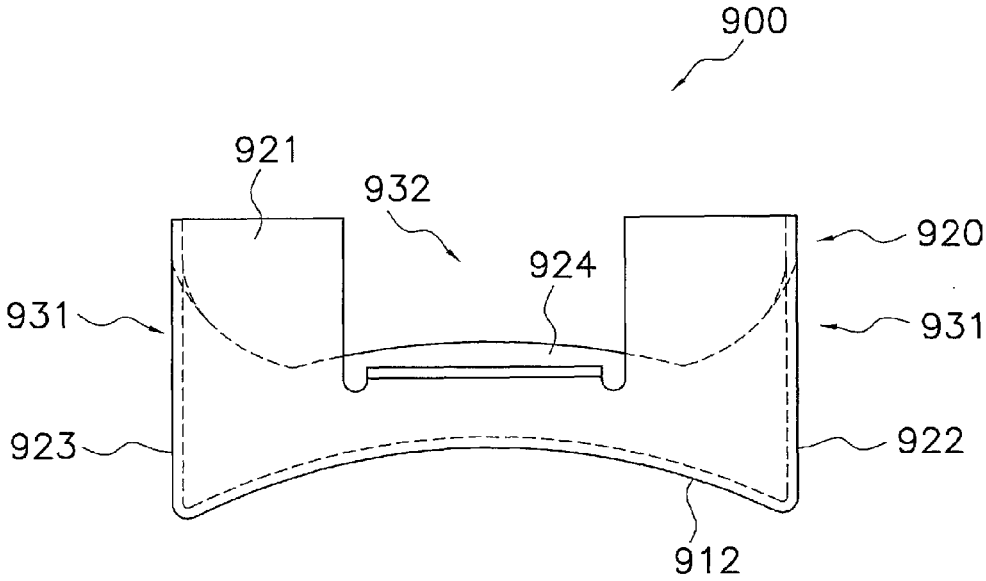
(Prior Art) Fig. 25
FIG. 25 is a front view of the conventional terminal guard.
Figure 26:
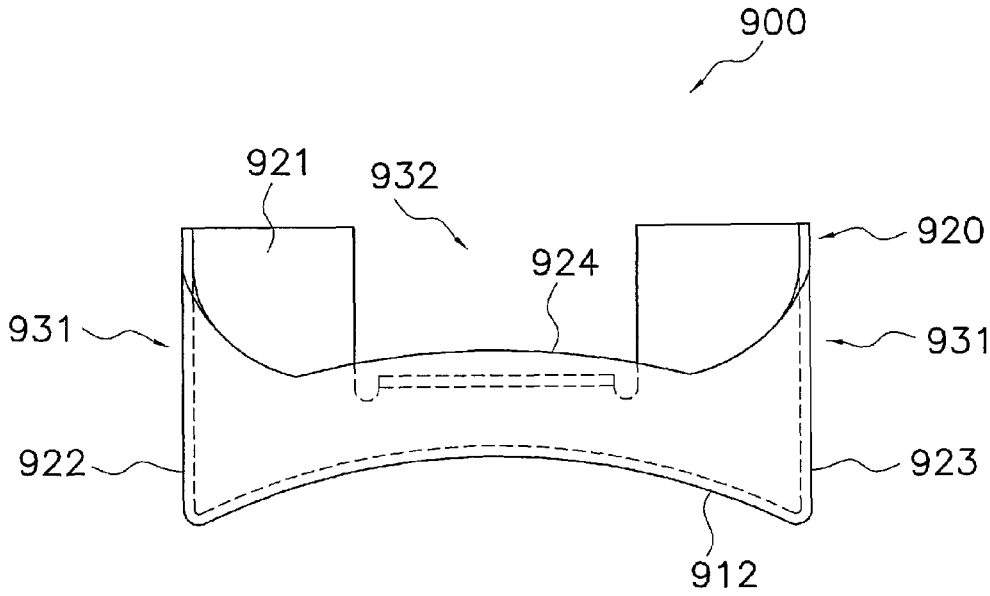
(Prior Art) Fig. 26
FIG. 26 is a rear view of the conventional terminal guard.

The terminal guard 10, as shown in FIGS. 1 to 5, is a guard made of metal and is mainly formed by a bottom portion 12 having a third opening 11 in order for a terminal 3 (refer to FIG. 16) to pass through and taking on a shape that follows the shape of the casing 2 (refer to FIG. 16), and a third enclosing wall portion 20 that stands from the brim of the bottom portion 12. Here, the third enclosing wall portion 20 includes four wall portions of a third front wall portion 21, a third rear wall portion 24, a third left wall portion 22, and a third right wall portion 23. Fourth openings 31 that are rectangular are provided each on the third left wall portion 22 and the third right wall portion 23 for engaging with claw portions (to be described later) of a terminal cover 40. In addition, here, of the surfaces that form the fourth openings 31, fifth surfaces Si, which are surfaces on the entering side of the claw portions 61 of the terminal cover 40, are planes that are orthogonal to the engaging direction Dj of the terminal cover 40. In addition, a third lead wire pass-through opening 32 is provided on the third front wall portion 21 for guiding a lead wire (not shown) connected with a terminal pin 4 of the terminal 3 to outside of the terminal guard 10.

(2) Terminal Cover

The terminal cover 40, as shown in FIGS. 6 to 11, is a cover roughly square and made of resin, and is mainly formed from a roughly square upper wall portion 41, and a fourth enclosing wall portion 50 that extends downward from the brim of the upper wall portion 41, and fits inside the terminal guard 10 described previously (refer to FIGS. 14 and 15). Here, the fourth enclosing wall portion 50 includes four wall portions of a fourth front wall portion 51, a fourth rear wall portion 54, a fourth left wall portion 52, and a fourth right wall portion 53. In addition, here, wall portions refer to the portions having surfaces orthogonal to the upper surface Sa of the upper wall portion 41. Claw portions 61 are each provided on the fourth left wall portion 52 and the fourth right wall portion 53, approximately in the center in the width direction (in the center in the depth direction when looking at the terminal cover 40 as a whole), and extend towards the lower end from approximately the center in the height direction. In addition, the claw portions 61, as shown in FIGS. 6, 7, 9, 10, and 11, protrude outward from the fourth left wall portion 52 and the fourth right wall portion 53.

This claw portion 61, as shown in FIGS. 35(*a*) and 35(*b*), is made up of a first claw wall portion 64, which is a wall orthogonal to the engaging direction Dj on the opposite side from the engaging direction Dj toward the fourth opening 31, and second claw wall portions 65*a*, 65*b*, which are two walls that extend toward the engaging direction Dj from two end portions 64*c* of the first claw wall portion 64. As a result, a concave portion 66 is formed between these second claw wall portions 65*a* and 65*b* (refer to FIG. 12). The bottom surface Sb of this concave portion 66 is on the same plane as the outer surface of the fourth left wall portion 52 or the fourth right wall portion 53, and is orthogonal to the standing direction Dw of the first claw wall portion 64 and the second claw wall portions 65*a*, 65*b*.

The first claw wall portion 64 includes an eleventh surface Sf1, which is a surface formed on the side in the opposite direction from the engaging direction Dj and orthogonal to the engaging direction Dj, a twelfth surface Sf2 that slopes towards the claw portion protruding direction Dp following towards the engaging direction Dj, and a thirteenth surface Sf3 that slopes towards the opposite direction from the claw portion protruding direction Dp following towards the engaging direction Dj.

The second claw wall portions 65*a*, 65*b* include a fourteenth surface Sf4 that slopes towards the opposite direction from the claw portion protruding direction Dp following towards the engaging direction Dj. In addition, this fourteenth surface Sf4 is continuous with the thirteenth surface Sf3 of the first claw wall portion 64.

Figure 27:
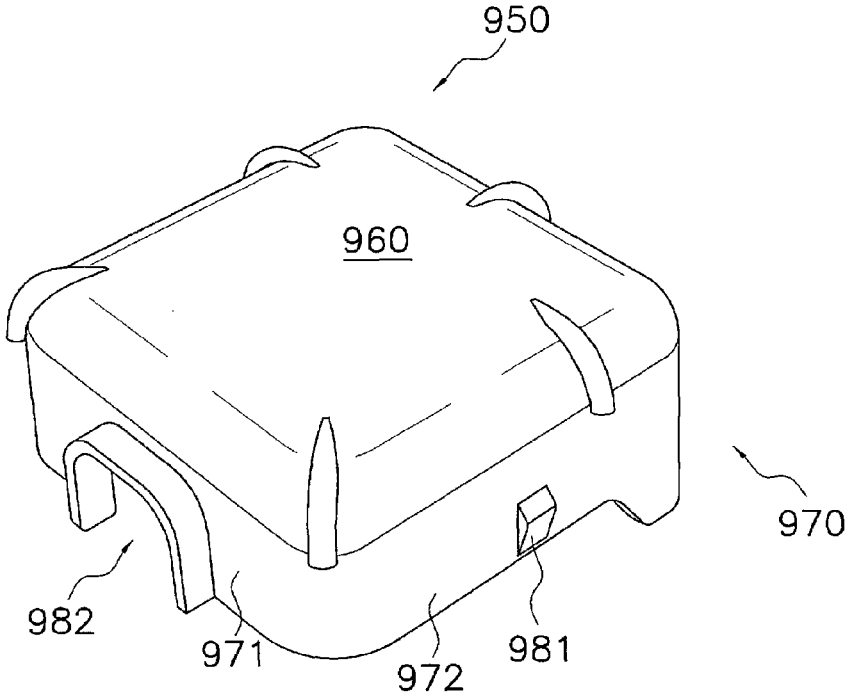
(Prior Art) Fig. 27
FIG. 27 is an appearance perspective view of a conventional terminal cover.
Figure 28:
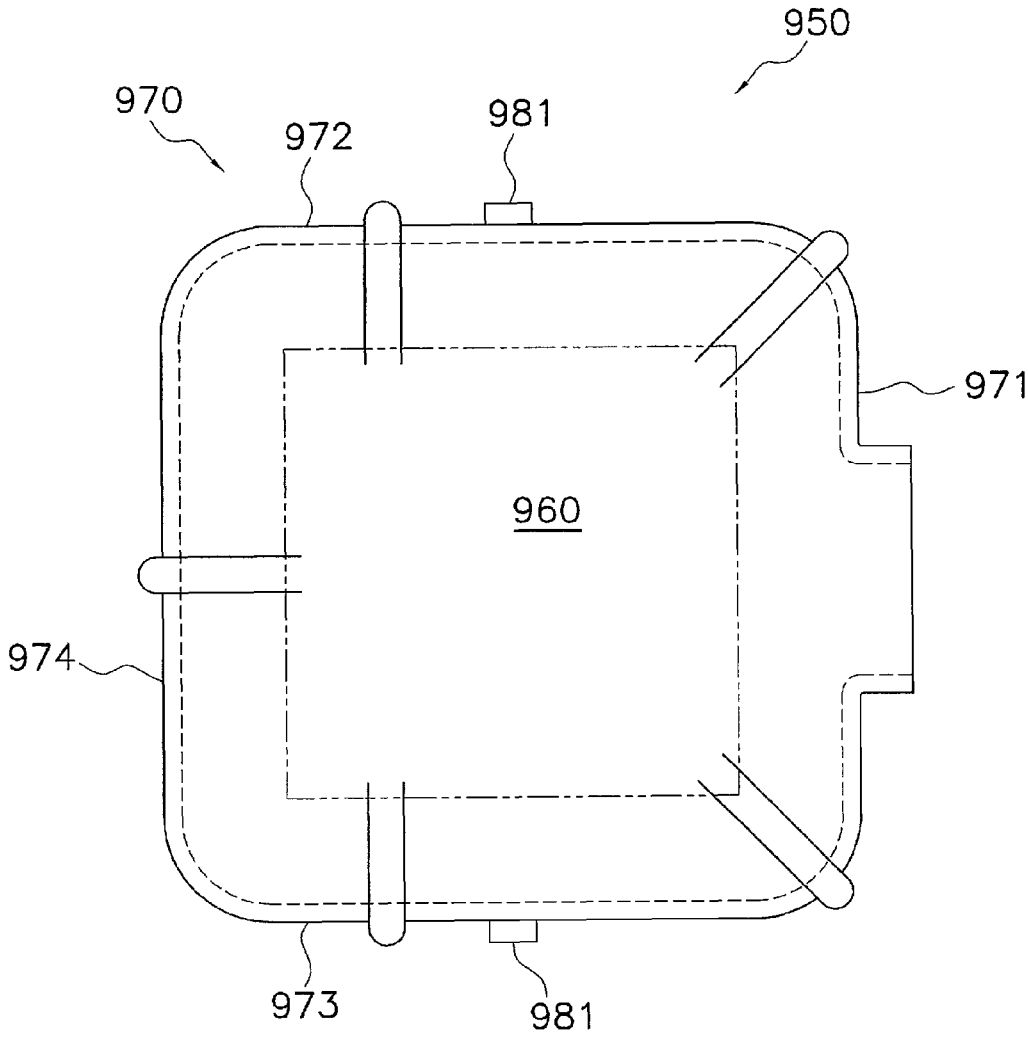
(Prior Art) Fig. 28
FIG. 28 is a top view of the conventional terminal cover.
Figure 29:
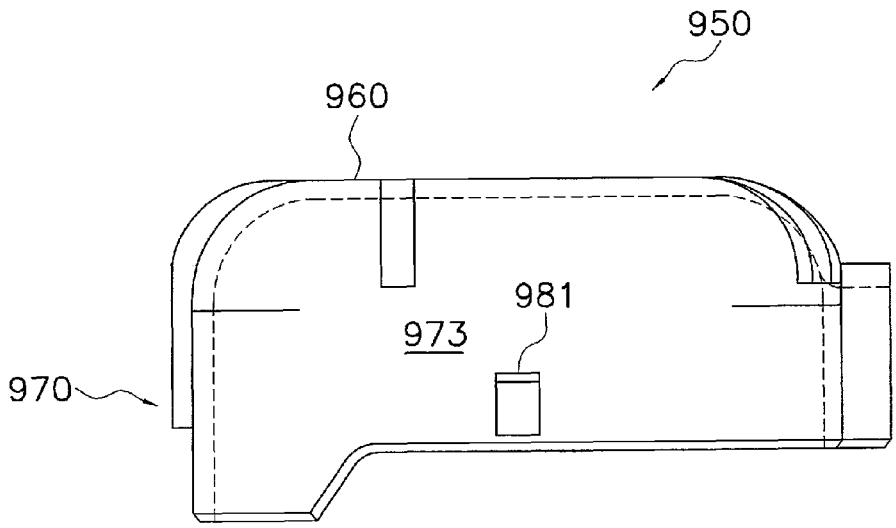
(Prior Art) Fig. 29
FIG. 29 is a right side view of the conventional terminal cover.
Figure 30:
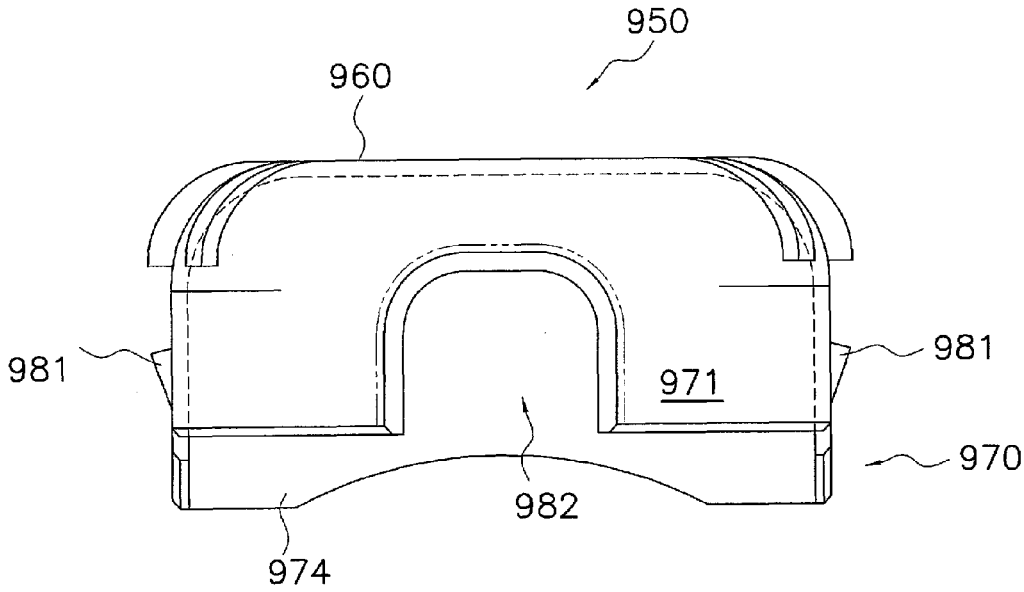
(Prior Art) Fig. 30
FIG. 30 is a front view of the conventional terminal cover.
Figure 31:
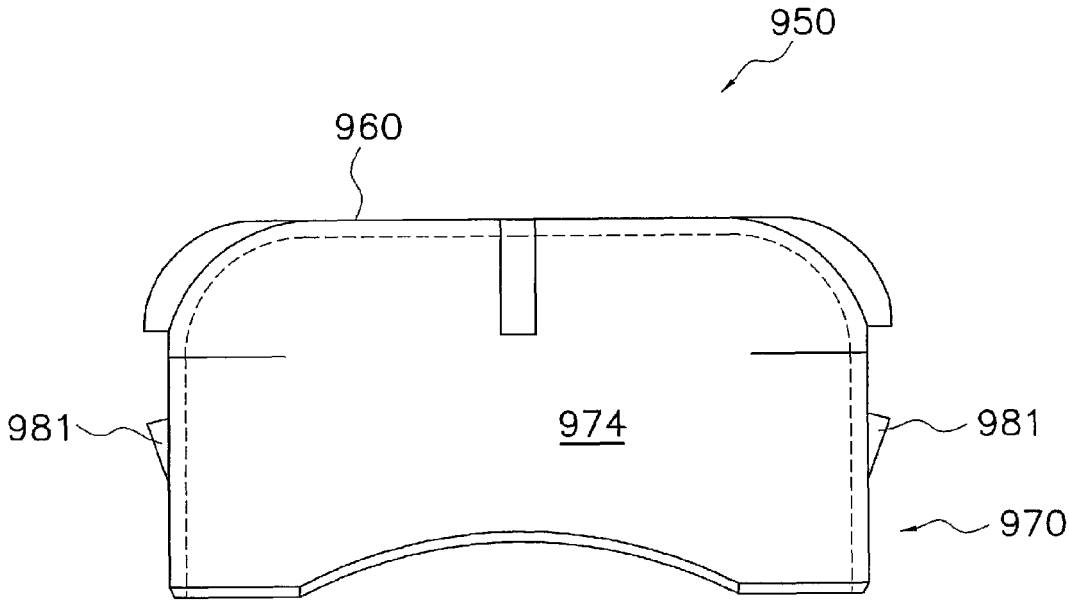
(Prior Art) Fig. 31
FIG. 31 is a rear view of the conventional terminal cover.
Figure 32:
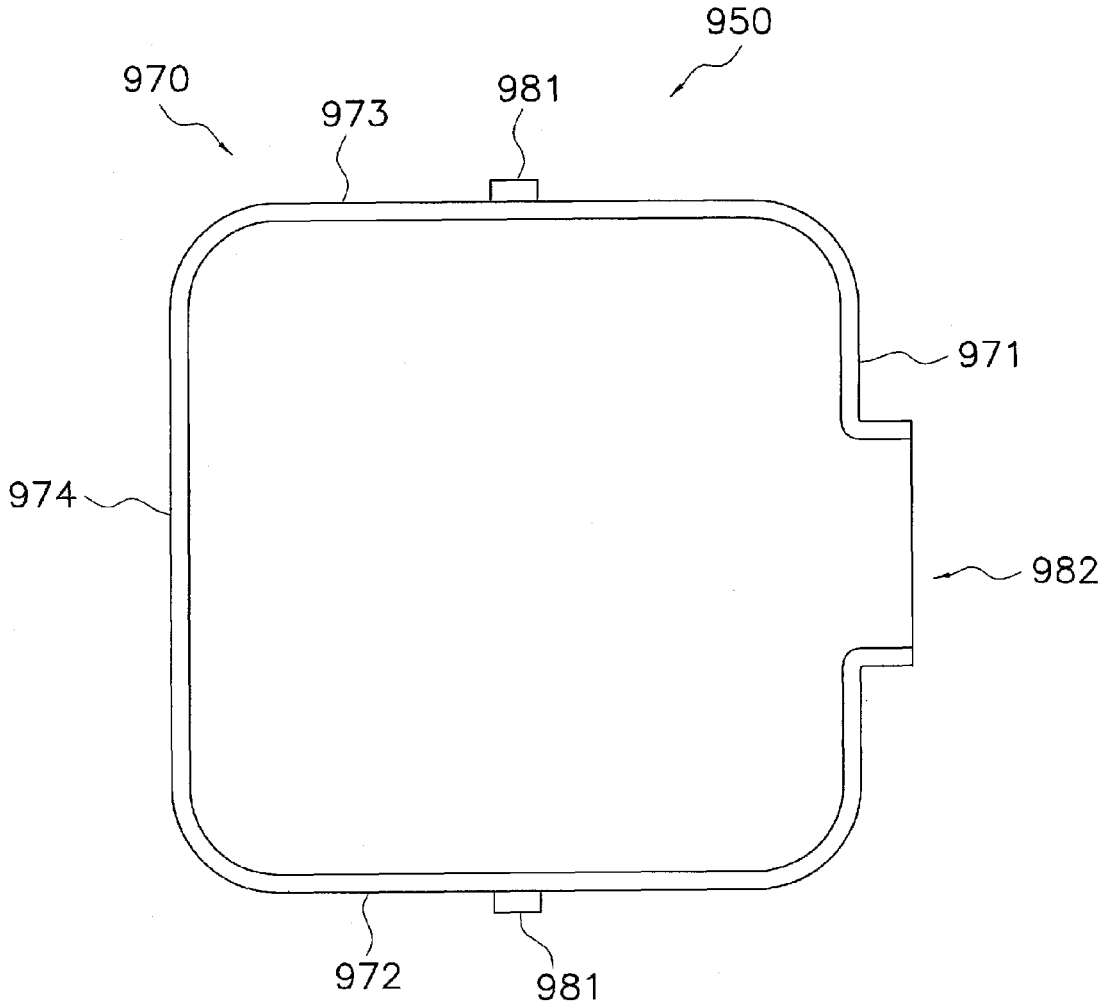
(Prior Art) Fig. 32
FIG. 32 is a diagram showing the underside surface of the conventional terminal cover.
Figure 33:
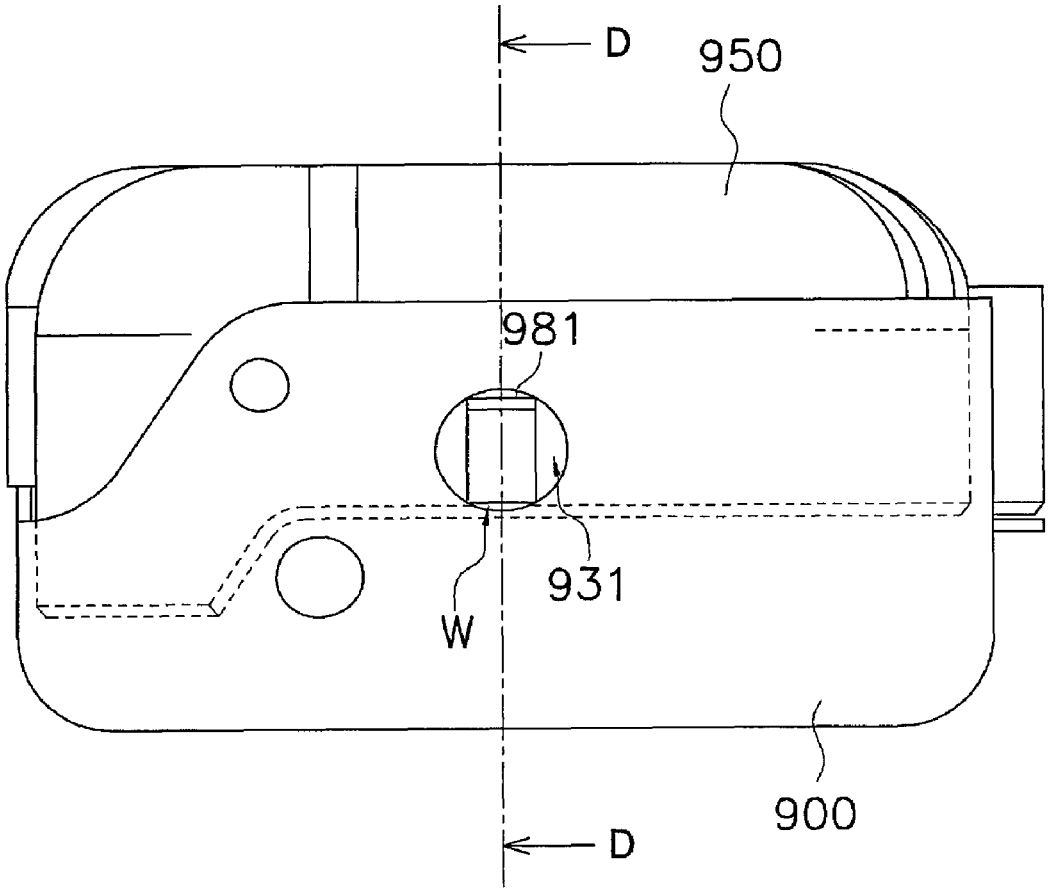
(Prior Art) Fig. 33
FIG. 33 is a right side view showing when the conventional terminal cover is engaged with the conventional terminal guard.
Figure 34:
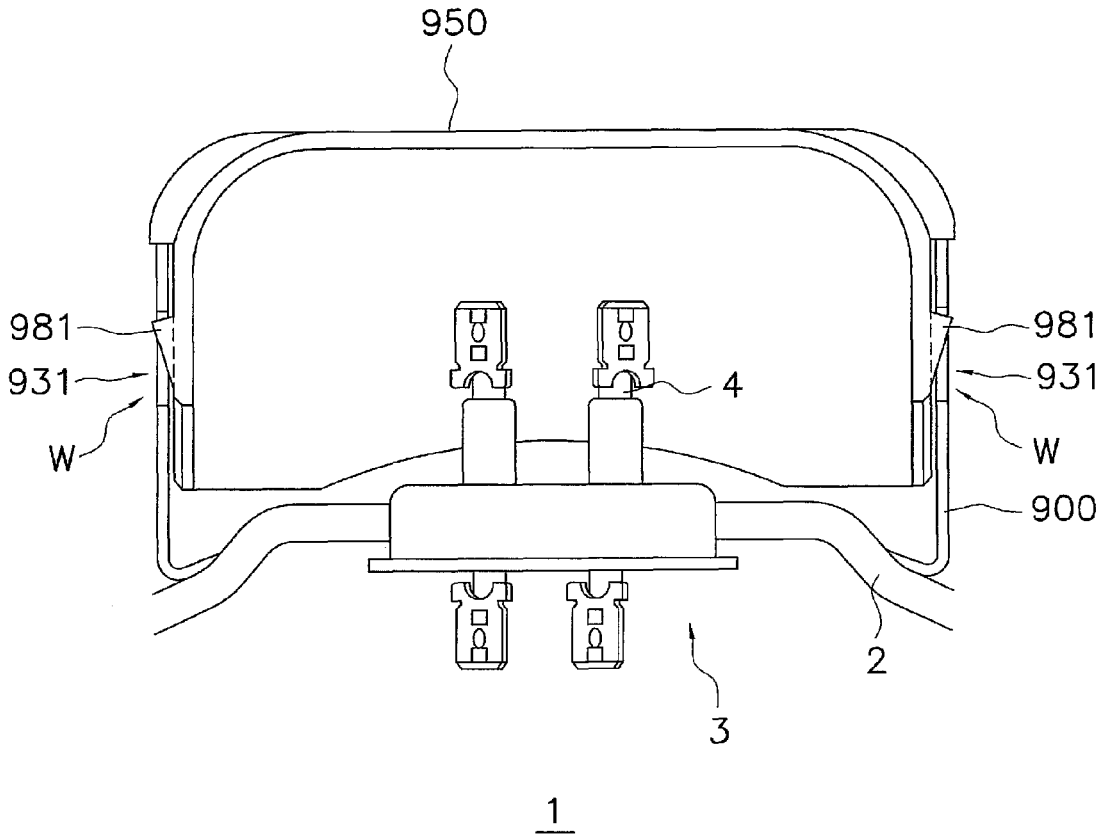
(Prior Art) Fig. 34
FIG. 34 is a section D-D showing when the conventional terminal cover is engaged with the conventional terminal guard.

In addition, slits 63 arranged near the claw portions 61 to sandwich the claw portions 61 are formed to extend from roughly the upper end towards the engaging direction Dj to the lower end, and are each provided on the fourth left wall portion 52 and the fourth right wall portion 53. Furthermore, opening covering portions PB (refer to FIG. 8), being portions sandwiched by the slits 63 on the fourth left wall portion 52 and the fourth right wall portion 53, are extended more to the lower end (engaging direction) than a corresponding portion of a conventional terminal cover 950 (refer to FIGS. 27 and 29), and functions as shielding plates so that the jig used for the removal will not bump into the terminal 3. In addition, here, the height direction is orthogonal to the claw portion protruding direction Dp, and is parallel to the engaging direction Dj. In addition, a fourth lead wire pass-through opening 62 is provided on the fourth front wall portion 51 for guiding a lead wire connected to the terminal pin 4 of the terminal 3 to outside of the terminal cover 40.

In addition, as shown in FIG. 11, a reinforcing rib 67 is provided on the inner surface on this terminal cover 40. The reinforcing rib 67 is made up of circular ribs 67*a* (refer to FIG. 13) aligned on the underside surface of the upper wall portion 41 spaced out at predetermined intervals in the width direction and depth direction of the terminal cover 40, a plurality of first linear ribs 67*b* arranged on first imaginary lines that pass through the centers of the plurality of circular ribs 67*a* and parallel to the width direction for connecting the plurality of circular ribs 67*a*, a plurality of second linear ribs 67*c* arranged on second imaginary lines that pass through the centers of the plurality of circular ribs 67*a* and that are parallel to the depth direction for connecting the plurality of circular ribs 67*a*, first curved ribs 67*d* formed all the way to the lower end of the fourth left wall portion 52 and the fourth right wall portion 53 following the sectional shape when the terminal cover 40 is cut at a plane including the first imaginary line from the circular ribs 67*a* arranged on the two ends in the width direction, and second curved ribs 67*e* formed all the way to the lower end of the fourth front wall portion 51 and the fourth rear wall portion 54 following the sectional shape when the terminal cover 40 is cut at a plane including the second imaginary line from the circular ribs 67*a* arranged at the two ends in the depth direction. In addition, here, the width direction is parallel to the claw portion protruding direction Dp, and orthogonal to the engaging direction Dj. In addition, the depth direction is orthogonal to the claw portion protruding direction Dp, and also orthogonal to the engaging direction Dj.

When the terminal cover 40 is engaged with the terminal guard 10, a terminal protective body is formed as shown in FIGS. 14 and 15. With this terminal protective body, as shown in FIG. 14, the fourth opening 31 of the terminal guard 10 is covered completely by the fourth left wall portion 52 or the fourth right wall portion 53 of the terminal cover 40.

Characteristics of the Terminal Protective Body (1)

With the terminal cover 40 according to this embodiment, when the claw portions 61 and the fourth openings 31 are engaged, the portions PB sandwiched by the slits 63 of the fourth left wall portion 52 and the fourth right wall portion 53 cover all the pathways to the terminal 3 from the fourth openings 31. For this reason, a person who intends to remove the terminal cover 40 is able to do so successfully without damaging the terminal 3.

(2)

With the terminal cover 40 according to this embodiment, the claw portions 61 are each formed by the first claw wall portion 64 and the second claw wall portions 65*a* and 65*b*, and there is a concave portion 66 between the second claw wall portions 65*a* and 65*b*. Therefore, with this terminal cover 40, a person intending to remove it will be tempted to insert a jig used for the removal into the concave portions 66. And, by having the concave portions 66, this person will be able to push the claw portions 61 in the opposite direction from the protruding direction of the claw portions 61 easily. In addition, by having the first claw wall portions 64, the person will be able to easily lift up the terminal cover 40 in the direction opposite the engaging direction. Furthermore, by having the second claw wall portions 65*a* and 65*b*, a jig for the removal will not wiggle its way to the depth direction in the terminal cover 40.

(3)

With the terminal cover 40 according to this embodiment, the fourteenth surface Sf4 is formed on the second claw wall portions 65*a* and 65*b*. Therefore, a person intended to install the terminal cover 40 will be able to fit the terminal cover 40 in the terminal guard 10 easily.

(4)

Slits 63 are provided on the terminal cover 40 according to this embodiment. For this reason, it becomes easy to hold in the claw portions 61 in the opposite direction from the protruding direction, and a person intended to remove the terminal cover 40 will be able to remove it easily from the terminal guard 10.

(5)

With the terminal guard 10 according to this embodiment, the surfaces (fifth surfaces Si) on the entering side of the claw portions 61 of the terminal cover 40 of the surfaces that form the fourth openings 31 are flat surfaces, and has a relationship that is orthogonal to the engaging direction. With respect to this, with the terminal cover 40 according to this embodiment, surfaces (eleventh surfaces Sf1) orthogonal to the engaging direction Dj on the side in the opposite direction from the engaging direction Dj of the claw portions 61 are provided. Therefore, when the terminal cover 40 is fitted in the terminal guard 10, the fifth surfaces Si and the eleventh surfaces Sf1 are in surface contact with each other. For this reason, with the terminal protective body according to this embodiment, the terminal cover 40 is locked and fixed stably to the terminal guard 10.

Modification Examples (A)

With the terminal cover 40 according to the previous embodiment, the claw portions 61 are formed on the opening covering portions PB. However, the fourth openings 31 of the terminal guard 10 may be covered with the terminal covers designed as shown in FIGS. 17 to 21. In other words, a left covering wall 152 and a right covering wall 153 that are parallel to the fourth left wall portion 52 and the fourth right wall portion 53 are provided in the interior of the terminal cover 140. In addition, in this case, the portions sandwiched by the slits 63 of the fourth left wall portion 52 and the fourth right wall portion 53 may be the same length as the corresponding portion of the conventional terminal cover 950 (refer to FIGS. 27 and 29). In addition, in this case, claw portions 161 without the concave portions 66 may be adopted. By doing so, a person intending to remove the terminal cover 40 can do so successfully without harming the terminal 3, even by using a conventional removing method.

(B)

With the terminal cover 40 according to the previous embodiment, the bottom surface Sb of the concave portion 66 is on the same plane as the outer surface of the fourth left wall portion 52 or the fourth right wall portion 53. However, the bottom surface Sb of the concave portion 66 does not have to be on the same plane as the outer surface of the fourth left wall portion 52 or the fourth right wall portion 53. For example, the bottom surface Sb of the concave portion 66 may be positioned closer to the claw portion protruding side than the outer surface of the fourth left wall portion 52 or the fourth right wall portion 53.

INDUSTRIAL APPLICABILITY

The terminal cover according to the present invention has a feature of allowing a person intending to remove it to be able to do so successfully without damaging the terminal, and is useful as a protective cover for the terminal of a compressor.

What is claimed is:

1. A terminal cover, comprising:

a claw portion being configured to engage with an opening provided on a terminal guard arranged to stand around a terminal protruding outward from a casing of a compressor, the claw portion engaging from an inner side of the terminal guard in an engaging direction toward the opening, the claw portion including a first wall portion being formed to extend orthogonally to the engaging direction and having two end portions and a first surface extending orthogonal to the engaging direction, two second wall portions extending in the engaging direction from the two end portions of the first wall portion, and a concave portion formed between the two second wall portions; and a covering portion covering all pathways to the terminal from the opening when the claw portion is engaged with the opening, the claw portion being mounted on the covering portion, the claw portion being sandwiched by slits extending towards the engaging direction, and the concave portion being on the same plane as and extending from the covering portion.

2. The terminal cover according to claim 1, wherein the covering portion includes a second surface that is parallel to the engaging direction, the second surface extends between the two second wall portions to the first wall portion, the first wall portion has a third surface that extends from the first surface and slopes in the engaging direction away from covering portion, and a fourth surface that extends from the third surface and slopes in the engaging direction toward the covering portion, and each of the second wall portions has an end surface that extends from and is continuous with the fourth surface and slopes in the engaging direction toward the covering portion to contact the covering portion.

3. A terminal cover, comprising:

a claw portion being configured to engage with an opening provided on a terminal guard arranged to stand around a terminal protruding outward from a casing of a compressor, the claw portion engaging from an inner side of the terminal guard in an engaging direction toward the opening, the claw portion including a first wall portion being formed to extend orthogonally to the engaging direction and having two end portions and a first surface extending orthogonal to the engaging direction, two second wall portions extending in the engaging direction from the two end portions of the first wall portion, a concave portion formed between the two second wall portions; and a covering portion covering all pathways to the terminal from the opening when the claw portion is engaged with the opening, the covering portion being provided separately from the claw portion, and being positioned between the claw portion and the terminal when the claw portion is engaged with the opening, the claw portion being sandwiched by slits extending towards the engaging direction, and the concave portion being on a plane parallel to the covering portion.

4. The terminal cover according to claim 3, wherein the covering portion includes a second surface that is parallel to the engaging direction, the second surface extends between the two second wall portions to the first wall portion, the first wall portion has a third surface that extends from the first surface and slopes in the engaging direction away from covering portion, and a fourth surface that extends from the third surface and slopes in the engaging direction toward the covering portion, and each of the second wall portions has an end surface that extends from and is continuous with the fourth surface and slopes in the engaging direction toward the covering portion to contact the covering portion.

5. A terminal protective structure, comprising:

a terminal guard being arranged to stand around a terminal protruding outward from a casing of a compressor, and having an opening; and a terminal cover including a claw portion being configured to engage with the opening, the claw portion engaging from an inner side of the terminal guard in an engaging direction toward the opening, the claw portion including a first wall portion being formed to extend orthogonally to the engaging direction and having two end portions and a first surface extending orthogonal to the engaging direction, two second wall portions extending in the engaging direction from the two end portions of the first wall portion, and a concave portion formed between the two second wall portions, a covering portion covering all pathways to the terminal from the opening when the claw portion is engaged with the opening, the claw portion being mounted on the covering portion, the claw portion being sandwiched by slits extending towards the engaging direction, the concave portion being on the same plane as and extending from the covering portion.

6. The terminal protective structure according to claim 5, wherein the covering portion includes a second surface that is parallel to the engaging direction, the second surface extends between the two second wall portions to the first wall portion, the first wall portion includes a third surface that extends from the first surface and slopes in the engaging direction away from the covering portion, and a fourth surface that extends from the third surface and slopes in the engaging direction toward the covering portion, and each of the second wall portions has an end surface that extends from and is continuous with the fourth surface and slopes in the engaging direction toward the covering portion to contact the covering portion.

7. A terminal protective structure, comprising:

a terminal guard being arranged to stand around a terminal protruding outward from a casing of a compressor, and having an opening; and a terminal cover including a claw portion being configured to engage with the opening, the claw portion engaging from an inner side of the terminal guard in an engaging direction toward the opening, the claw portion including a first wall portion being formed to extend orthogonally to the engaging direction and having two end portions and a first surface extending orthogonal to the engaging direction, two second wall portions extending in the engaging direction from the two end portions of the first wall portion, and a concave portion formed between the two second wall portions, and a covering portion covering all pathways to the terminal from the opening when the claw portion is engaged with the opening, the covering portion being provided separately from the claw portion, and being positioned between the claw portion and the terminal when the claw portion is engaged with the opening, the claw portion being sandwiched by slits extending towards the engaging direction, the concave portion being on a plane parallel to the covering portion.

8. The terminal protective structure according to claim 7, wherein the covering portion includes a second surface that is parallel to the engaging direction, the second surface extends between the two second wall portions to the first wall portion, the first wall portion includes a third surface that extends from the first surface and slopes in the engaging direction away from the covering portion, and a fourth surface that extends from the third surface and slopes in the engaging direction toward the covering portion, and each of the second wall portions has an end surface that extends from and is continuous with the fourth surface and slopes in the engaging direction toward the covering portion to contact the covering portion.

* * * * *